US007543893B2

(12) United States Patent
LaPointe

(10) Patent No.: US 7,543,893 B2
(45) Date of Patent: Jun. 9, 2009

(54) ROCKING RECLINING CHAIR

(75) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 323 days.

(21) Appl. No.: 11/483,700

(22) Filed: Jul. 10, 2006

(65) Prior Publication Data

US 2007/0241589 A1 Oct. 18, 2007

Related U.S. Application Data

(60) Provisional application No. 60/792,367, filed on Apr. 14, 2006.

(51) Int. Cl.
*A47C 1/035* (2006.01)

(52) U.S. Cl. ..... 297/463.1; 297/85; 16/422

(58) Field of Classification Search ..... 297/69, 297/83–85, 183.1, 183.9, 463.1, 463.2; 16/422
See application file for complete search history.

(56) References Cited

U.S. PATENT DOCUMENTS 951,836 A * 3/1910 Noack ..... 403/362
1,146,054 A * 7/1915 Curry ..... 74/545
2,733,942 A * 2/1956 Palmer ..... 74/548
2,870,823 A 1/1959 Staples
3,096,121 A 7/1963 Knabusch et al.
3,484,132 A * 12/1969 Biagi ..... 297/69
3,484,133 A * 12/1969 White et al. ..... 297/69
3,880,413 A 4/1975 Platt et al.
4,161,891 A 7/1979 Bossert
4,183,494 A 1/1980 Cleveland
4,306,746 A 12/1981 Crum
4,593,430 A 6/1986 Spangler et al.
4,595,233 A 6/1986 Fox
5,328,235 A 7/1994 Saul et al.
5,704,686 A 1/1998 May
5,722,278 A 3/1998 Horino et al.
5,800,010 A 9/1998 May
5,823,614 A 10/1998 Johnson et al.
6,135,559 A 10/2000 Kowalski (Continued)

OTHER PUBLICATIONS

International Search Report for PCT/US07/01409 dated Sep. 5, 2008 (RO/US).

*Primary Examiner*—Peter R. Brown
(74) *Attorney, Agent, or Firm*—Harness, Dickey & Pierce, P.L.C.

(57) ABSTRACT

A furniture item includes a support member and a rotatably pinned mechanism operable in rocking and reclining motions. The mechanism includes first and second side plates; a first pair of forward link members each rotatably connected to one of the side plates; a pantograph linkage set connected to the first pair of forward link members to extend and retract a footrest assembly in the reclining motion; and a drive rod rotatable between the side plates. Rotating the drive rod extends or retracts the pantograph linkage set. An escutcheon connected to the drive rod has a snap-engaged handle to manually rotate the drive rod. At least one U-shaped spring connected between the support member and the mechanism allows rocking motion. A seat pan has flat body springs extending over a seat pan aperture to support an occupant. A detent at one end of each flat spring engages the seat pan.

9 Claims, 27 Drawing Sheets

U.S. PATENT DOCUMENTS

| | | | |
|---|---|---|---|
| 6,142,558 | A | 11/2000 | May |
| 6,231,120 | B1 | 5/2001 | Wiecek |
| 6,309,015 | B1 | 10/2001 | Pine |
| 6,557,934 | B2 | 5/2003 | Wiecek |
| 6,637,813 | B2 | 10/2003 | Wiecek |
| 6,729,686 | B2 | 5/2004 | May |
| 6,733,071 | B2 | 5/2004 | Guillot et al. |
| 2004/0245840 | A1 | 12/2004 | Tubergen et al. |
| 2005/0017561 | A1 | 1/2005 | Burmeister, III et al. |
| 2005/0067867 | A1 | 3/2005 | May |

* cited by examiner

FIG 17
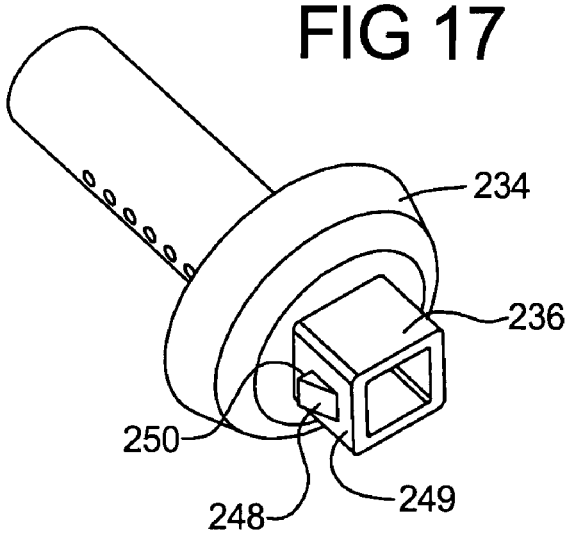
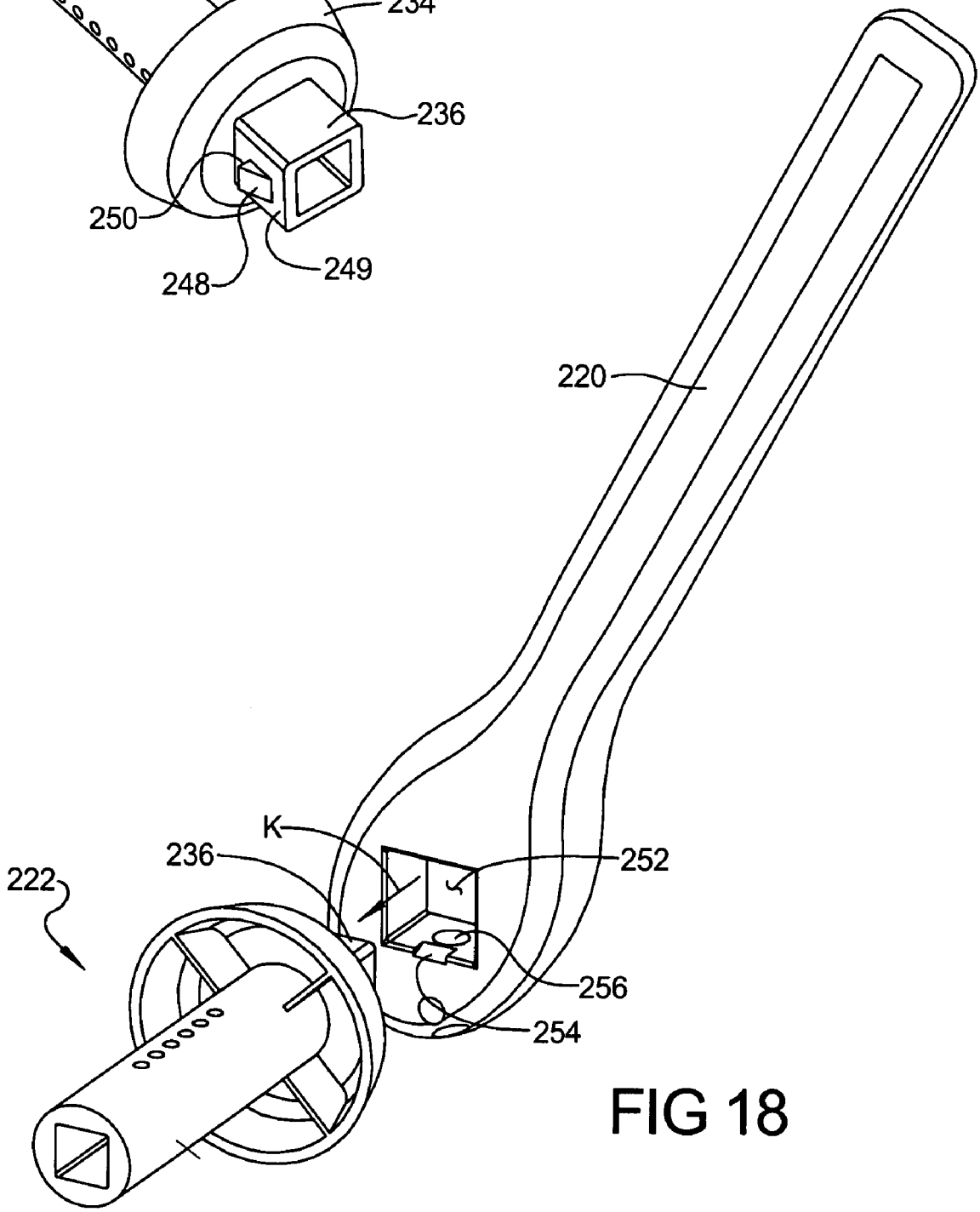
FIG 18

ROCKING RECLINING CHAIR

CROSS-REFERENCE TO RELATED APPLICATIONS

This application claims the benefit of U.S. Provisional Application No. 60/792,367, filed on Apr. 14, 2006. The disclosure of the above application is incorporated herein by reference.

FIELD

The present disclosure relates to furniture member operating mechanisms and to a device and method for operating a reclining furniture member assembly.

BACKGROUND

The statements in this section merely provide background information related to the present disclosure and may not constitute prior art.

Conventionally, reclining articles of furniture (i.e., chairs, sofas, loveseats, and the like) require a mechanism to bias a leg rest assembly in the extended and stowed positions. Known mechanisms commonly include a large number of moving parts that tends to increase the manufacturing time and costs associated with the furniture.

Most reclining rocking chairs include an upholstered chair frame supported from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., stowed or retracted) and elevated (i.e., extended or protracted) positions. The drive mechanism is manually-operated and includes a handle which, when rotated by the seat occupant, causes concurrent rotation of a drive rod for extending or retracting the leg rest assembly. Disadvantages of known mechanisms for providing these functions include a large quantity of parts, and their requirement of one or several spring biasing elements to permit retraction of the various chair components from their extended positions.

As an additional comfort feature, a latching mechanism may also be provided for releasably retaining the chair frame in one or more rearwardly rocked or "tilted" positions on the base assembly following extension of the leg rest assembly towards its extended position. In this manner, normal "rocking" action of the rocking chair is inhibited until the leg rest assembly is returned to its normally "stowed" position. Known leg rest mechanisms also provide multiple functional positions, which can be reached using a detente mechanism, which temporarily holds the leg rest at each successive position. Disadvantages of these mechanism designs result as the furniture member rocks backward when the leg rest is moved between the successive positions, and due to the multiple components required to engage and disengage the mechanisms. An improved mechanism is therefore desirable to eliminate the above disadvantages.

SUMMARY

According to several embodiments of a rocking reclining chair of the present disclosure, a furniture member includes a support member. A mechanism rotatably pinned to the support member is adapted for both rocking and reclining motions. The mechanism includes opposed first and second side plates; a first pair of forward link members each rotatably connected to one of the first and second side plates; a second pair of rear link members each rotatably connected to one of the first and second side plates; a pantograph linkage set connected to the first pair of forward link members and operable to extend and retract a footrest assembly; and a drive rod supported for rotatable motion between the first and second side plates, rotation of the drive rod operable to each of extend and retract the pantograph linkage set. An escutcheon is selectively and releasably connected to a first end of the drive rod. The escutcheon has a plurality of connection apertures individually selectable to vary a working length of the drive rod and a width between the first and second side plates.

According to further embodiments, a furniture member having rocking and reclining functions includes a support member. A mechanism is rotatably pinned to the support member and adapted for both rocking and reclining motions. The mechanism includes opposed first and second side plates; a first pair of forward link members each rotatably connected to one of the first and second side plates; a second pair of rear link members each rotatably connected to one of the first and second side plates; a pantograph linkage set connected to the first pair of forward link members and operable to extend and retract a footrest assembly; and a drive rod supported for rotatable motion between the first and second side plates, rotation of the drive rod operable to each of extend and retract the pantograph linkage set. A base frame supports the support member. At least one biasing member is connected between the base frame and the support member to permit forward and backward rocking motions of the furniture member.

According to still further embodiments, a furniture member frame includes a seat pan having a homogenous body and a clearance aperture created within a perimeter of the body. A plurality of flat body spring elements are individually non-fastenably connected using a detent element to one of a forward and a rearward facing edge of the seat pan and suspended above the clearance aperture in a non-weight bearing condition. A back frame has opposed first and second back braces, the back frame rotatably supported with respect to the seat pan, the back frame rotatable between each of a fully upright position and a fully reclined position. At least one lumbar flat body spring having a looped feature with a detent element created at opposed ends, the lumbar flat body spring non-fastenably connected to each of the first and second back braces using the looped feature and the detent element.

According to yet still further embodiments, an escutcheon is selectively and releasably connected to a first end of the drive rod. A handle is snap-engageable on the escutcheon. The handle operates to manually rotate the drive rod.

According to additional embodiments, a toggle lever is connected to and rotatable in cooperation with the drive rod. A stop drive link is rotatably connected to each of the first and second side plates. The stop drive link operates in contact with the toggle lever to support the foot rest assembly in successive ratcheting positions.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 17 is a perspective elevational view of an escutcheon engagement drive end of the present disclosure;

FIG. 18 is a perspective assembly view of an escutcheon and handle assembly of the present disclosure;

DETAILED DESCRIPTION

Figure 1:
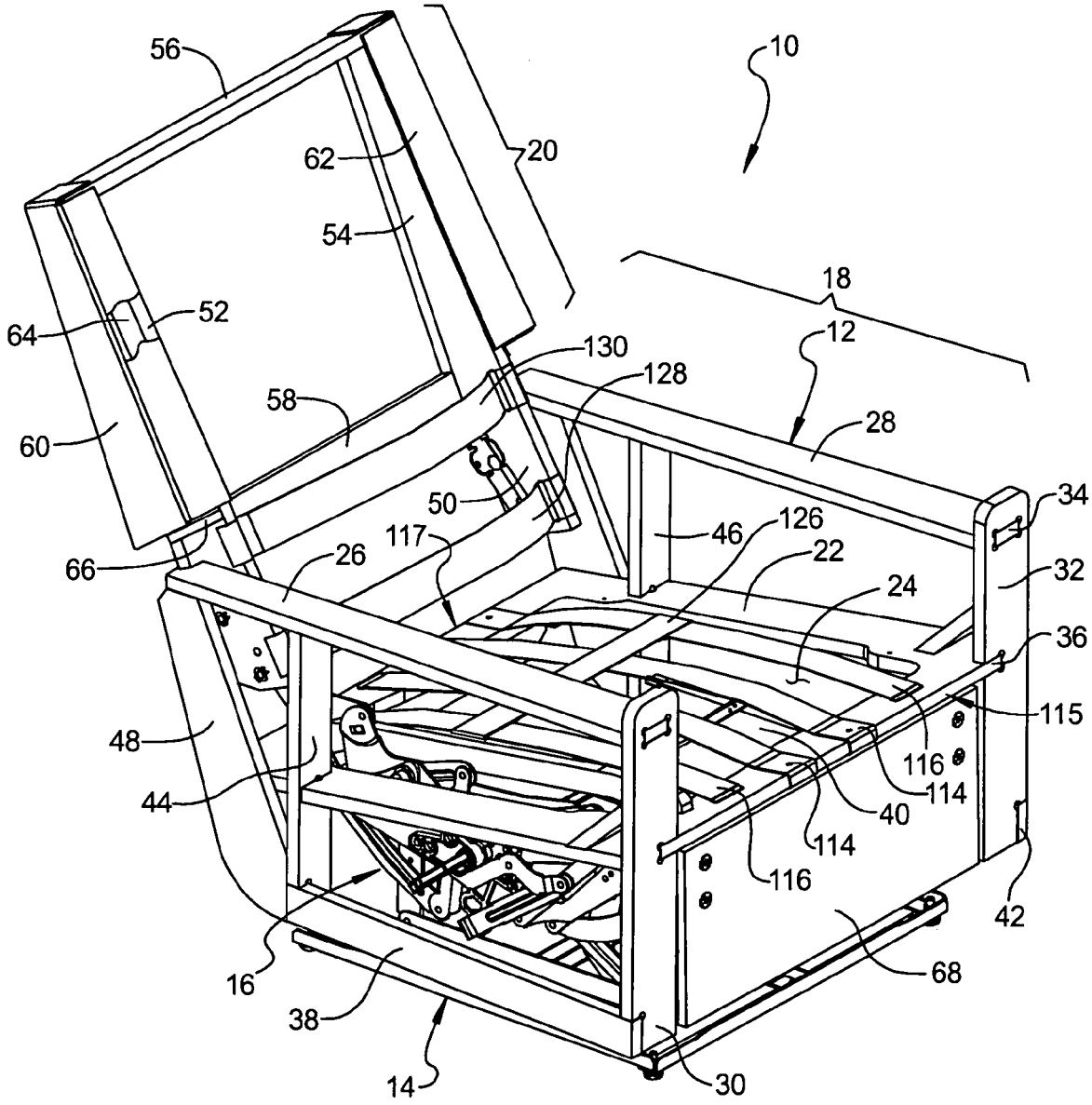
FIG. 1 is a perspective view of an un-upholstered rocking reclining chair of the present disclosure.

The following description is merely exemplary in nature and is not intended to limit the present disclosure, application, or uses. It should be understood that throughout the drawings, corresponding reference numerals indicate like or corresponding parts and features.

Referring generally to FIG. 1, a rocking reclining chair 10 includes a body 12, a base frame 14 supporting the body 12, and a mechanism 16 supported by both the base frame 14 and body 12. Body 12 is divisible into each of a chair frame section 18 and a back frame section 20. Chair frame section 18 includes a seat pan 22 which according to several embodiments includes a unitary piece of material such as plywood, composite material, or similar structurally homogenous, jointless body. A clearance aperture 24 is provided in seat pan 22 providing downward displacement space for an occupant of rocking reclining chair 10. Mechanism 16 includes linkages, motion inserts, and connecting members that are similar to U.S. patent application Ser. No. 11/328,722 filed Jan. 10, 2006, entitled "WALL PROXIMITY RECLINING CHAIR WITH IN-LINE LINKAGE MECHANISM", the subject matter of which is incorporated herein by reference.

Chair frame 18 further includes a first arm support 26 and an opposite second arm support 28. First arm support 26 is connected to a first front post 30 and second arm support 28 is connected to a second front post 32. Each of the first and second arm supports 26, 28 are connected to their respective front posts 30, 32 using a mortise/tenon joint 34. The mortise/tenon joints 34 are selected to maximize the joint strength for the joined components which are substantially perpendicular to each other. A double-notched joint 36 is created by notching each of seat pan 22 and both first and second front posts 30, 32 to mechanically join seat pan 22 to each of the first and second arm supports 26, 28.

Chair frame 18 still further includes each of a first and second lower rail 38, 40 connected to first and second front posts 30, 32 respectively. First and second lower rails 38, 40 are connected to each of first and second front posts 30, 32 using a rabbet joint 42. Chair frame 18 also includes each of a first and second rear post 44, 46. First rear post 44 is connected to both first arm support 26 and first lower rail 38. Similarly, second rear post 46 is connected to both second arm support 28 and second lower rail 40. A first filler post 48 is connected between first arm support 26 and the connection area between first rear post 44 and first lower rail 38. Similarly, a second filler post 50 is connected between second arm support 28 and the joint created between second rear post 46 and second lower rail 40. First and second filler posts 48, 50 provide a curved geometry to visually complete the rearward section of chair frame 18.

Back frame 20 includes a first back brace 52 and a second back brace 54 having an upper cross rail 56 and a lower cross rail 58 connected between first and second back braces 52, 54. For appearance and to provide suitable area for upholstery, a first back extension 60 is connected-to first back brace 52 and a second back extension 62 is connected to second back brace 54. Each of the first and second back extensions 60, 62 can be connected to their respective first and second back brace 52, 54 using each of a first extension spacer 64 and a second extension spacer 66. A foot rest panel 68 is mechanically coupled to mechanism 16 and extendable from the stowed position shown.

Figure 2:
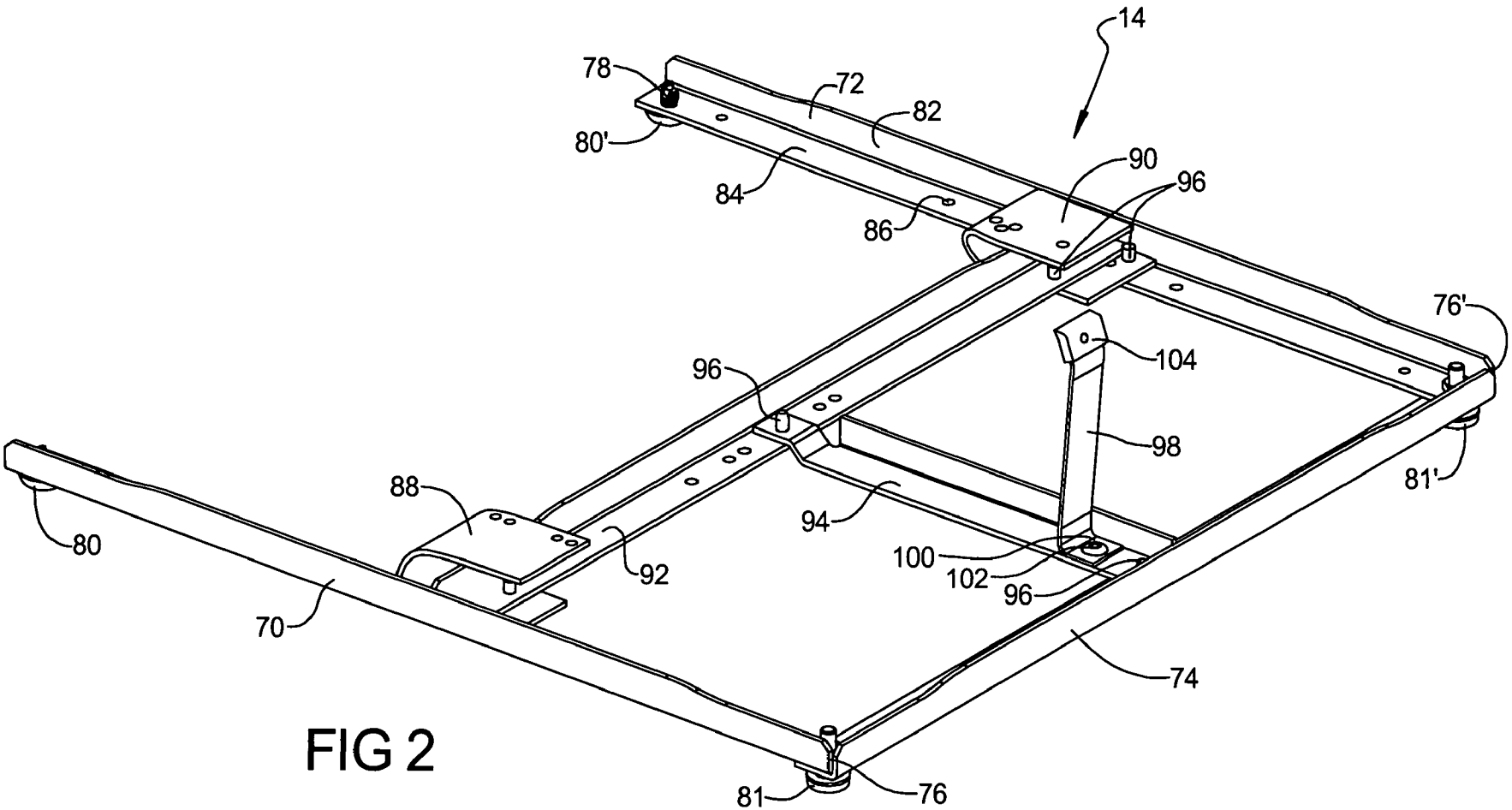
FIG. 2 is a perspective view of a base frame of the chair of FIG. 1.

Referring now generally to FIG. 2, base frame 14 is created by connecting each of three substantially equivalent members including a first side channel 70, a second side channel 72 and a first cross channel 74. An overlapping joint 76, 76' is created at the connection between first side channel 70 and first cross channel 74 and between second side channel 72 and first cross-channel 74 respectively. A foot mount fastener 78 is used to threadably fasten a fixed foot 80, 80' to each of first side channel 70 and second side channel 72 respectively. Each fixed foot 80, 80' can be non-adjustable or in alternate embodiments can also be height adjustable. An adjustable height foot 81, 81' is used at the overlapping joints 76, 76' to permit height adjustability of base frame 14. Each of the first and second side channels and first cross channel, 70, 72, 74 include a first flange 82 and a second flange 84 oriented substantially perpendicular to first flange 82, defining a substantially L-shaped member. A plurality of apertures 86 are created in each of the second flanges 84. A first U-shaped leaf spring 88 is fastenably connected using apertures 86 to the second flange 84 of first side channel 70. Similarly, a second U-shaped leaf spring 90 is fastenably connected using apertures 86 to second flange 84 of second side channel 72. First and second U-shaped leaf springs 88, 90 are created of spring steel in several embodiments and are operable to permit a rocking motion for rocking reclining chair 10. Each of the first and second U-shaped leaf springs 88, 90 directly abut the second flange 84 of their appropriate side channels. A stiffener brace 92 is positioned in direct contact with each of the first and second U-shaped leaf springs 88, 90 and fastened through the appropriate leaf spring and second flange using a plurality of fasteners 96.

Base frame 14 further includes a pawl 98 which in several embodiments is created of a spring steel, and includes an attachment end 100 connected to an attachment brace 94 using a pawl mount fastener 102. Attachment brace 94 is constructed similar to first and second side channels 70, 72 and first cross channel 74 but is of different length. Attachment brace 94 is mounted to stiffener brace 92 and to second flange 84 of first cross channel 74 using a plurality of fasteners 96. Pawl 98 further includes a ratchet engaging end 104 which in several embodiments is a polymeric member fixed or non-releasably connected to a distal end of pawl 98. Ratchet engaging end 104 can also be releasably connected to pawl 98 if replacement is anticipated.

Figure 3:
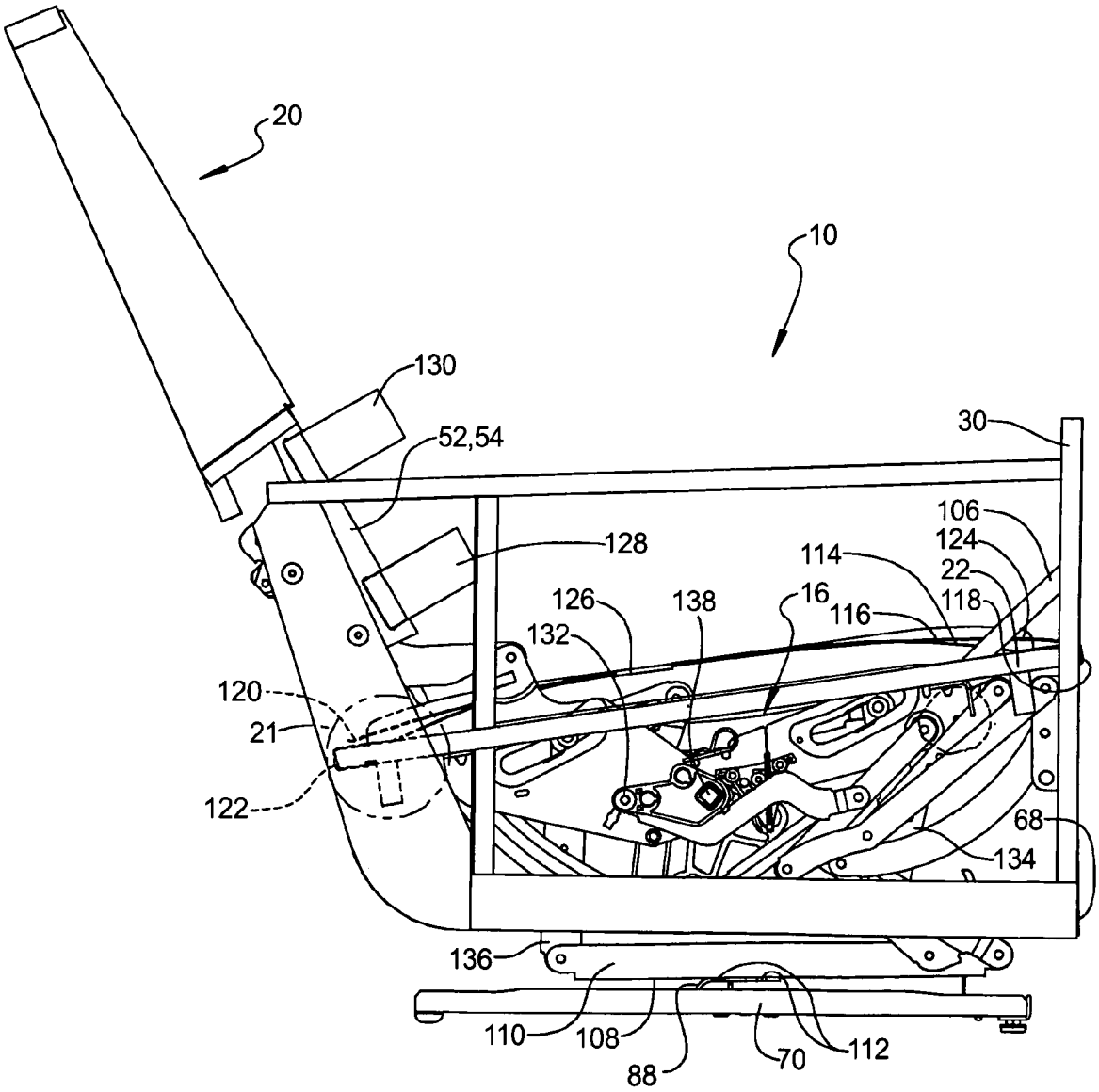
FIG. 3 is side elevational view of the chair of FIG. 1 in a fully upright and non-extended position.

Referring now to FIG. 3, chair frame 18 can further include a reinforcing brace 106 angularly positioned between seat pan 22 and each of first and second front posts 30, 32. Reinforcing braces 106 provide additional rigidity for chair frame 18. Mechanism 16 includes a lower flange 108 of a mechanism support member 110. Lower flange 108 provides apertures for a plurality of fasteners 112 which are used to fastenably connect each of first and second U-shaped leaf springs 88, 90 to lower flange 108 on opposed sides of mechanism 16. The weight of an occupant of rocking reclining chair 10 is supported by each of a first plurality of flat body springs 114 and a second plurality of flat body springs 116. Flat body springs 114, 116 are defined having a width substantially greater than a thickness. In several embodiments, flat body springs 114, 116 are created of spring steel, or an elastically deflectable polymeric or composite material. Each of the first plurality of flat springs 114 are connected to seat pan 22 at a forward facing edge 115 of seat pan 22. Conversely, each of the second plurality of flat springs 116 are connected to a rearward facing edge 117 of seat pan 22. For example, a looped end 118 of each of the first plurality of flat springs 114 is pre-formed to substantially conform to the geometry of seat pan 22.

Each of the first plurality of flat springs 114 also includes a free end 120 which when an occupant is not present is freely suspended above seat pan 22, and upon receiving the weight of the occupant is deflected downward into a contact position with seat pan 22 and thereafter allow flat springs 114 to compress vertically, while translating in contact with seat pan 22. Similarly, a looped end 122 is created for each of the connections between the second plurality of flat springs 116 and the rearward facing edge of seat pan 22. A free end 124 similar to free end 120 is provided at a forward end of each of the second plurality of flat springs 116 and function similar to free ends 120 of the first plurality of flat springs 114. A longitudinally rigid connecting member 126 which can be created of the same material as first and second flat springs 114, 116 is positioned substantially perpendicular to each of the first and second plurality of flat springs 114, 116 and used to join each of the first and second plurality of flat springs 114 and 116. The connection between each of the first and second plurality of flat springs 114, 116 to seat pan 22 is created by the detent elements which are described in reference to FIG. 21. Each of the first and second plurality of flat springs 114, 116 has the free ends 120, 124 freely suspended above seat pan 22 in a non-weight or non-load bearing condition, defined as a condition with no occupant on chair 10. Each of the free ends 120, 124 slidably contact seat pan 22 in a load or weight bearing condition, defined as occupant seated on chair 10 and downwardly loading the first and second plurality of flat springs 114, 116. Due to the use of detent elements, no fasteners are required to engage any of the first or second plurality of flat springs 114, 116 with seat pan 22. This reduces the time of construction as well as the cost of rocking reclining chair 10. Frictional engagement of the respective looped ends 118, 122 with seat pan 22 occurs in the weight bearing condition.

At least one and in several embodiments a plurality of flat springs are also used to help support the weight of an occupant to back frame 20. For this purpose, at least one first lumbar flat spring 128 is connected to each of the first and second back braces 52, 54. In several embodiments a second lumbar flat spring 130 is also connected to both first and second back braces 52, 54. First and second lumbar flat springs 128, 130 each also include opposed looped ends each similar to looped ends 118, 122 such that no mechanical fasteners are required to engage first or second lumbar flat springs 128, 130 with either of first or second back braces 52, 54. According to other embodiments, only a single lumbar flat spring is used, or three or more lumbar flat springs can be used. Material for the first and second back braces 52, 54 can be a spring steel, or material providing similar elastic properties.

Mechanism 16 can further include each of a toggle lever 132, a forward support link 134, and a rear support link 136. Toggle lever 132 is connected to a drive rod 138 which in several embodiments is square or rectangular in shape, can be solid or in tubular form, and is created of a metal or composite material. In several embodiments, toggle lever 132 is created of a polymeric material and each of the forward support link 134, rear support link 136, and drive rod 138 are created of a steel material. Each of the forward and rear support links 134, 136 are rotatably connected to mechanism support member 110 to allow motion of various components of mechanism 16. FIG. 3 shows rocking reclining chair 10 in a closed, or fully upright, non-extended, and non-rocked position.

Figure 4:
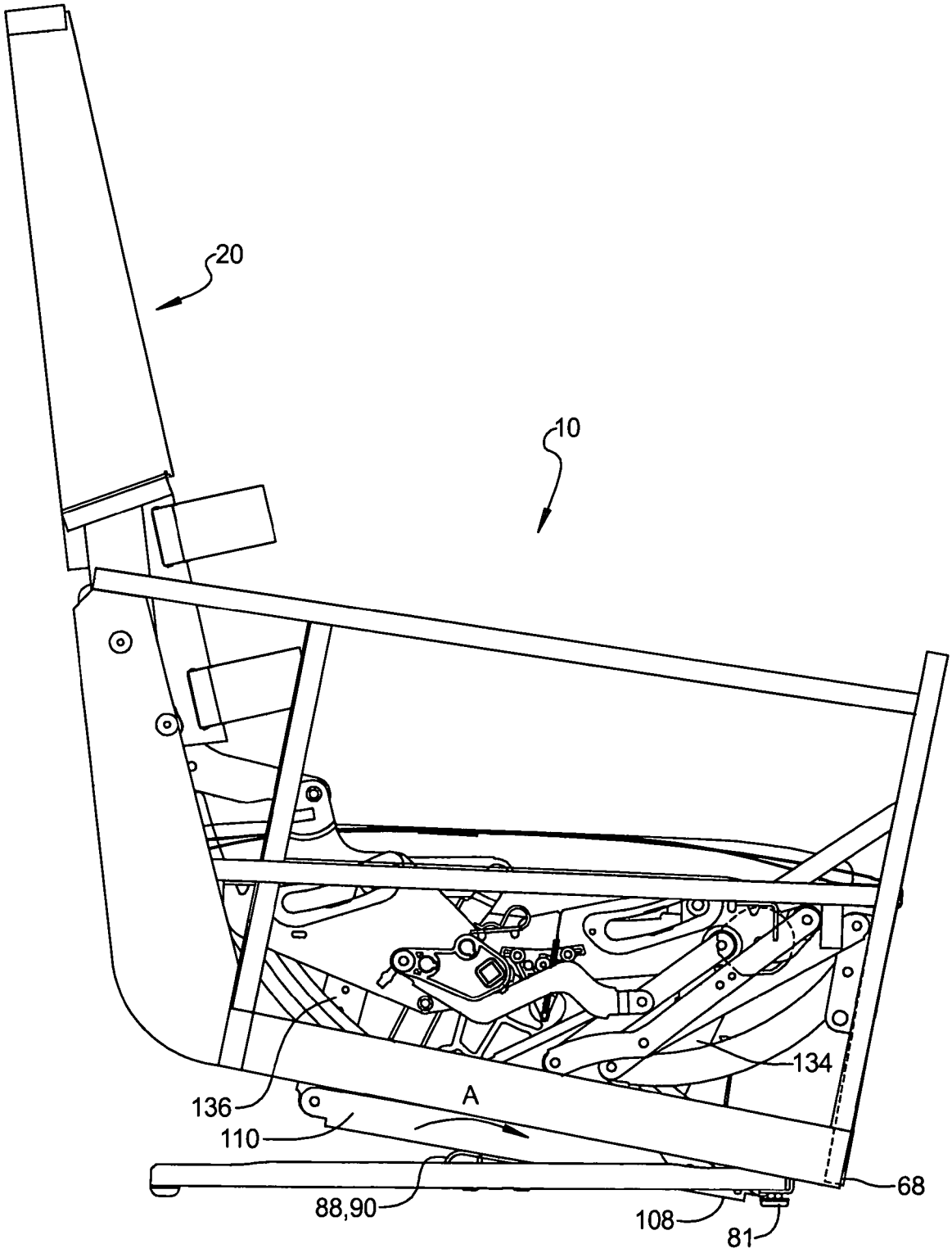
FIG. 4 is a side elevational view similar to FIG. 3, showing the chair in a fully forward rocked position.

Referring now generally to FIG. 4, rocking reclining chair 10 is shown in a forward rocked position which is achieved when an occupant leans forward and body 12 rotates about an arc of rotation "A" with respect to both first and second U-shaped leaf springs 88, 90. The position of back frame 20 with respect to base frame 14 and the orientation of each of forward and rear support links 134, 136 with respect to mechanism support member 110 are unchanged in the fully forward rocked position with respect to the position of rocking reclining chair 10 shown in FIG. 3. Foot rest panel 68 is also positioned in the withdrawn or fully retracted position similar to its position shown in FIG. 3.

Figure 5:
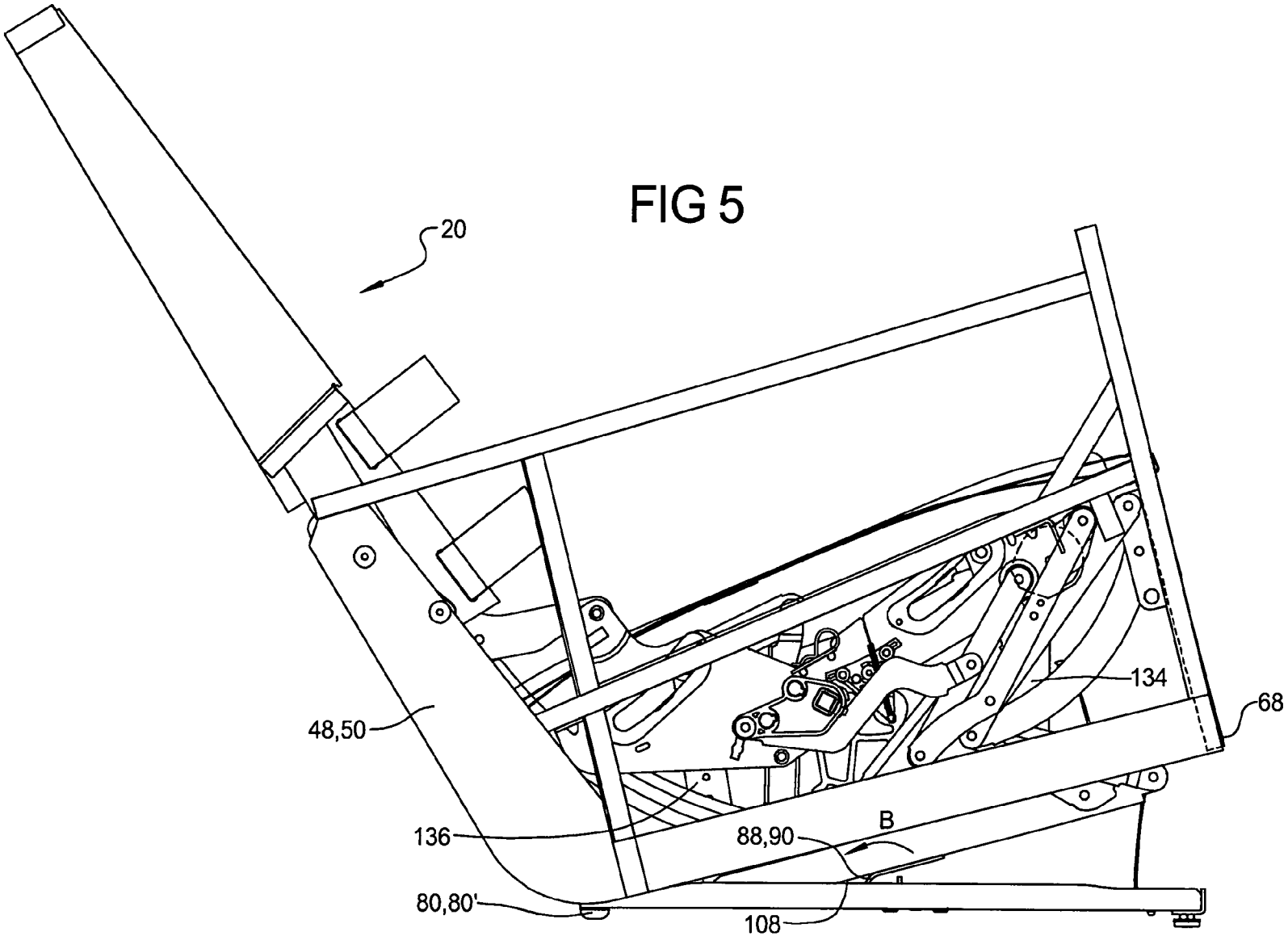
FIG. 5 is a side elevational view similar to FIG. 3, showing the chair in a fully rearward rocked position.

As best seen in reference to FIG. 5, a fully rearward rocked position of rocking reclining chair 10 is shown. To reach this position, the weight of the occupant is positioned rearward with respect to first and second U-shaped leaf springs 88, 90 to rotate rocking reclining chair 10 from the fully upright position shown in FIG. 3 about an arc of rotation "B" with respect to each of the first and second U-shaped leaf springs 88, 90. In the fully rearward rocked position, each of the first and second filler posts 48, 50 are retained above the elevation of fixed feet 80, 80' so no other component of rocking reclining chair 10 contacts a ground or floor surface other than the support feet. Similar to the fully forward rocked position shown in FIG. 4, no other component of rocking reclining chair 10 is displaced with respect to the fully upright position shown in FIG. 3 when the rocking reclining chair 10 is repositioned to the fully rearward rocked position.

Figure 6:
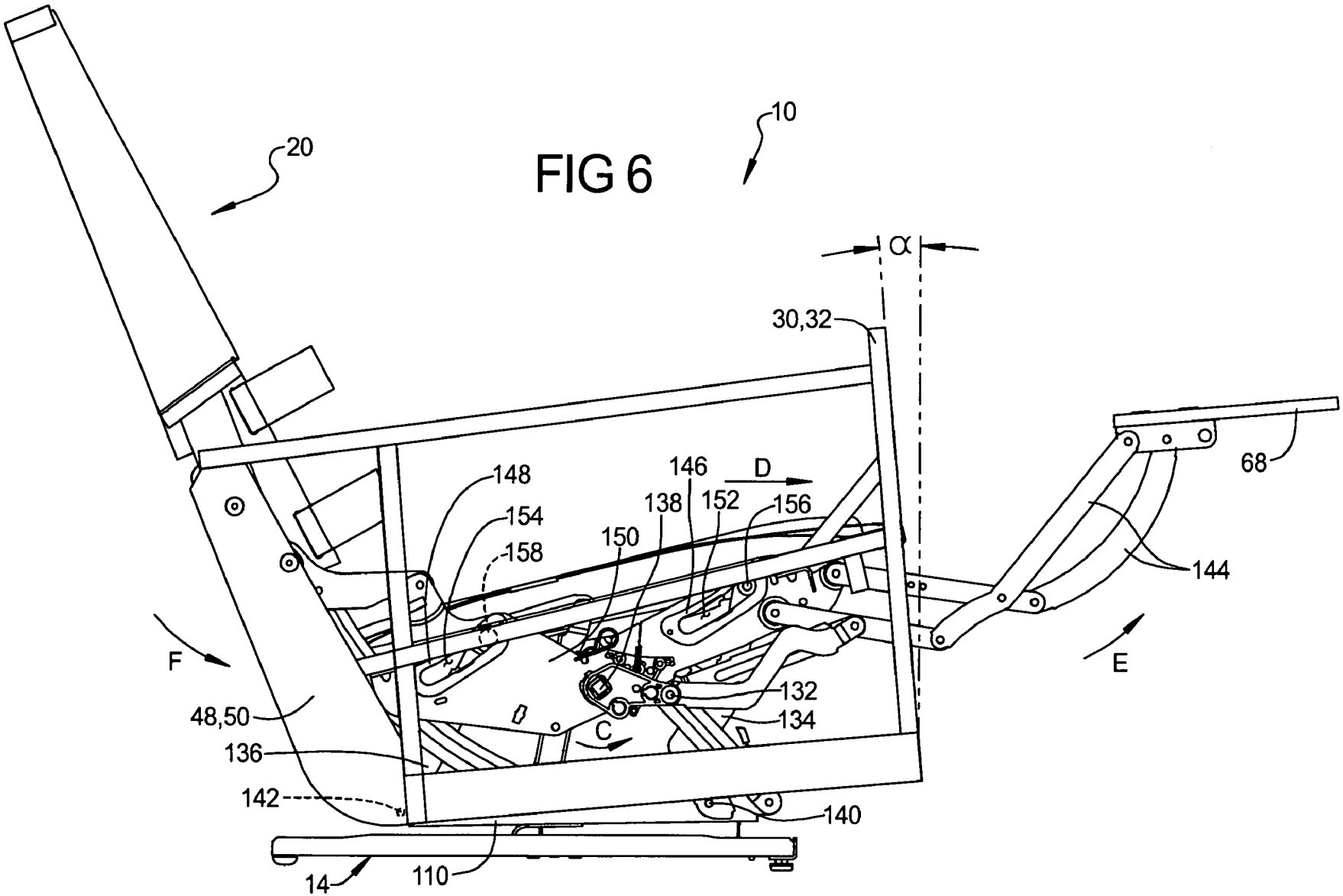
FIG. 6 is a side elevational view similar to FIG. 3, showing the legrest in a fully extended position.

Referring now to FIG. 6, rocking reclining chair 10 is repositioned from the upright position shown in FIG. 3 to a leg rest fully extended position. To accomplish this, drive rod 138 is rotated counter-clockwise in a drive rod rotation arc "C" which releases toggle lever 132. Each of forward and rear support links 134 and 136 rotate with respect to each of a first and second pinned joint 140, 142 respectively, to allow portions of mechanism 16 to displace in a translation direction "D". This translation permits foot rest panel 68 to be displaced about a leg rest extension arc "E" with pantograph linkages 144 extending forward and outward. As forward and rear support links 134, 136 rotate, each of first and second filler posts 48, 50 rotate and lower with respect to base frame 14 in a substantially downward arc "F". Each of first and second front posts 30, 32 are repositioned from a substantially upright or vertical position within an angle of rotation $\alpha$ which reorients the occupant toward a slightly upward viewing angle identified generally as a "TV position". Back frame 20 does not rotate during the displacement of foot rest panel 68, and mechanism support member 110 remains substantially parallel to base frame 14.

Each of a first and a second motion insert 146, 148 which are pre-connected to a connecting plate 150 include respectively a first elongated slot 152 and a second elongated slot 154. An upper end of forward support link 134 is pinned via a first motion pin 156 positioned within first elongated slot 152. Similarly, rear support link 136 is pinned via a second motion pin 158 positioned within second elongated slot 154. In the foot rest fully extended position shown, each of the first and second motion pins 156, 158 are positioned substantially in their forward-most position with respect to each the first and second elongated slots 152, 154.

Figure 7:
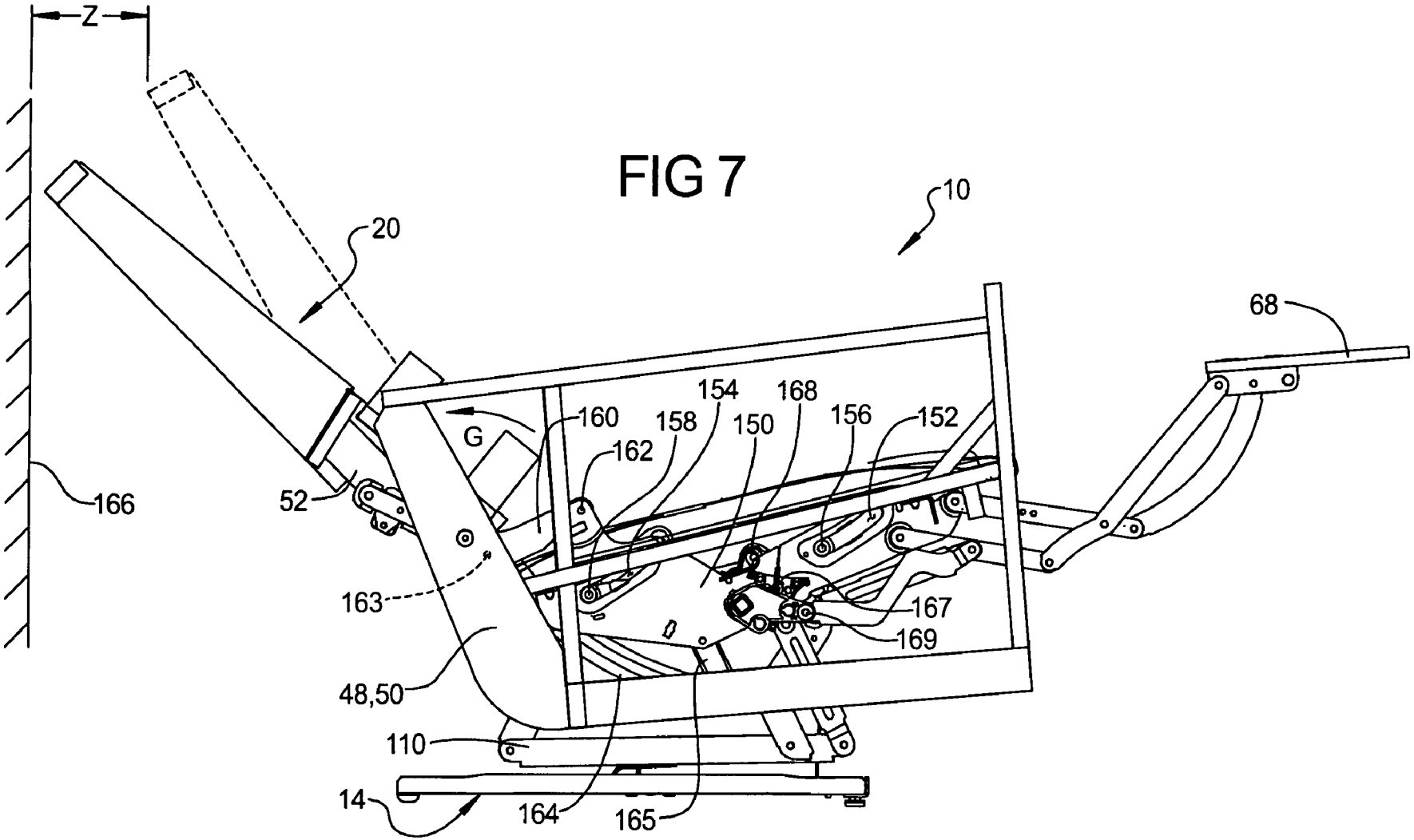
FIG. 7 is a side elevational view similar to FIG. 6, further showing the backrest in a fully reclined position.

Referring now generally to FIG. 7, rocking reclining chair 10 is further shown having back frame 20 rotated rearward from the leg rest fully extended position shown in FIG. 6 to achieve a fully reclined position of rocking reclining chair 10. A seat back support arm 160, 160' (160' is not shown in this view) which are connected to each of first and second back braces 52, 54 are rotatably pinned using seat back rotation pins 162, 162' (162' is not visible in this view). First and second back braces 52, 54 are therefore rotatable about a seat back arc of rotation "G" about seat back rotation pins 162, 162' to reach the fully reclined position. The fully reclined position is achieved with the weight of the occupant directed toward back frame 20 causing back frame 20 to rotate about seat back arc of rotation "G". As also shown in FIG. 7, in the fully reclined position, first and second motion pins 156, 158 are displaced within each of their respective first and second elongated slots 152, 154 to a fully rearward position within the first and second elongated slots 152, 154.

Also during displacement of back frame 20 to the fully reclined position, a pin 163 connected between seat back support arm 160 and an arc link 164 causes rotation of a rotating link 165. Rotation of rotating link 165 causes an upward and forward displacement of both first and second filler posts 48, 50 which reduces rearward displacement of back frame 20, thereby reducing the amount of wall clearance required behind rocking reclining chair 10 to achieve the fully reclined position. In several embodiments, a wall clearance dimension "Z" of eight to ten inches is required between back frame 20 and a wall 166 when back frame 20 is in the fully upright position to allow back frame 20 to rotate toward wall 166 and reach the fully reclined position. A stop drive link 167 is also connected to connecting plate 150. Stop drive link 167 rotates when drive rod 138 is rotated until stop drive link 167 contacts a rotation stop pin 168 which prevents further rotation of foot rest panel 68. A stop drive member 169 is also connected to drive rod 138 which is also rotatably connected to stop drive link 167 which functions to limit the rotation of drive rod 138.

Figure 8:
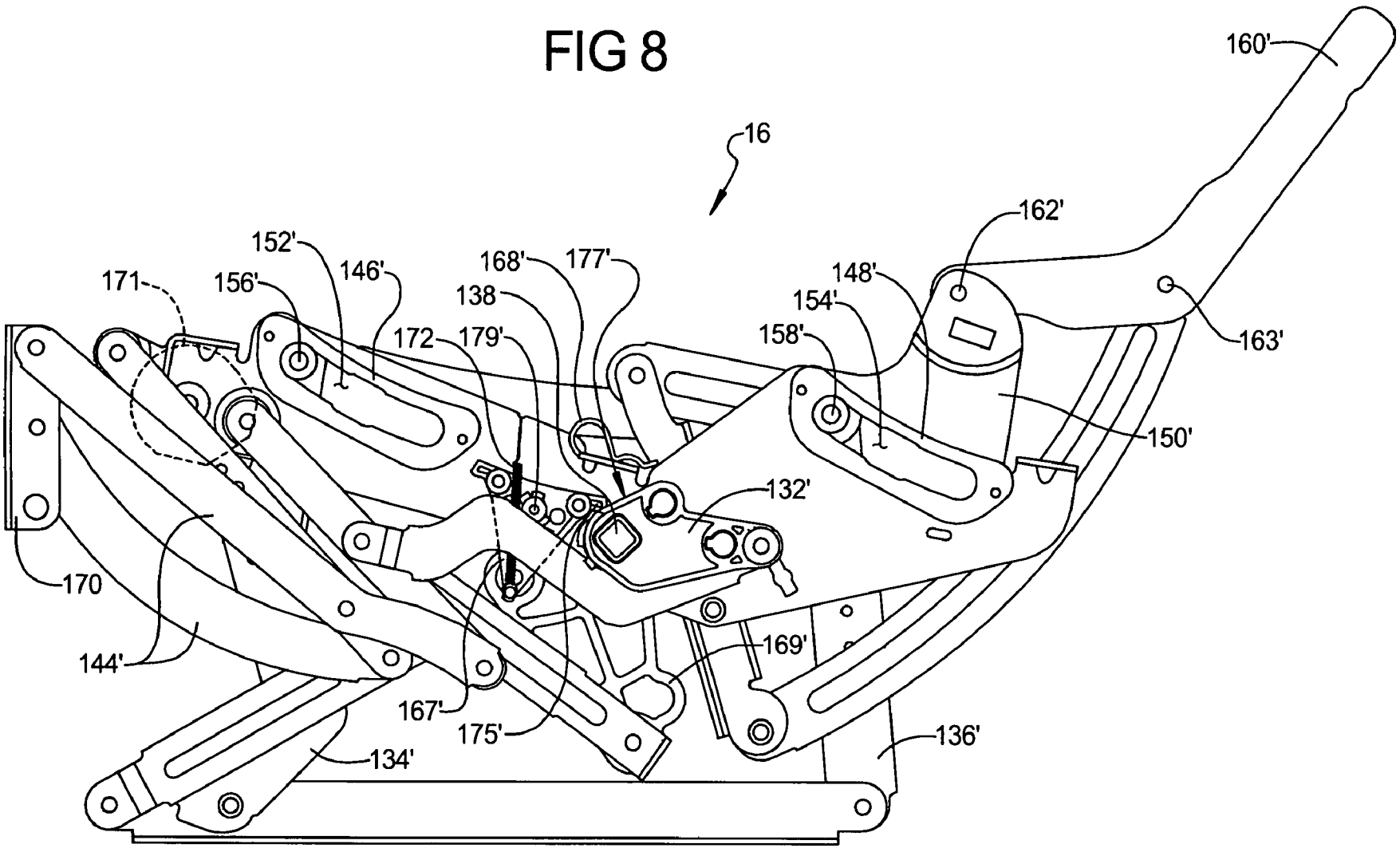
FIG. 8 is a side elevational view of the mechanism for the chair of FIG. 1.

Referring now generally to FIG. 8, mechanism 16 is more clearly shown in the fully upright position of rocking reclining chair 10 with respect to an occupant's left hand side of mechanism 16. Part numbers having prime values are therefore substantially equivalent to the same parts on the operator's right hand side of mechanism 16. A foot rest mount plate 170 is provided at distal ends of each of the pantograph linkages 144, 144' to which foot rest panel 68 is fastened. A cam 171 is also provided which allows the installer and/or the user to select the amount of downward force that is required to move foot rest panel 68 from the fully upright to the fully extended position. Cam 171 provides at least two and in several embodiments three alternate positions sequentially selectable to allow an increasing amount of weight to be borne by the leg rest assembly. Therefore the manufacturer or user can adjust mechanism for a lighter weight or heavier weight occupant to maintain the leg rest fully extended position before motion back to the leg rest fully upright position is allowed.

Stop drive link 167' is pinned for rotation with stop drive member 169'. Stop drive link 167' is further rotatably mounted to connecting plate 150' and can rotate about a mounting pin 179' when various cam surfaces of toggle lever 132' in response to rotation of drive rod 138 contact an arm 175' of stop drive link 167'. A biasing element 172, 172' which in several embodiments is a coiled spring biases stop drive link 167 or stop drive link 167' to an over-center position helping to maintain the fully upright position of mechanism 16. Arm 175' contacts a first cam surface 177' of toggle lever 132' in the fully upright position.

Figure 9:
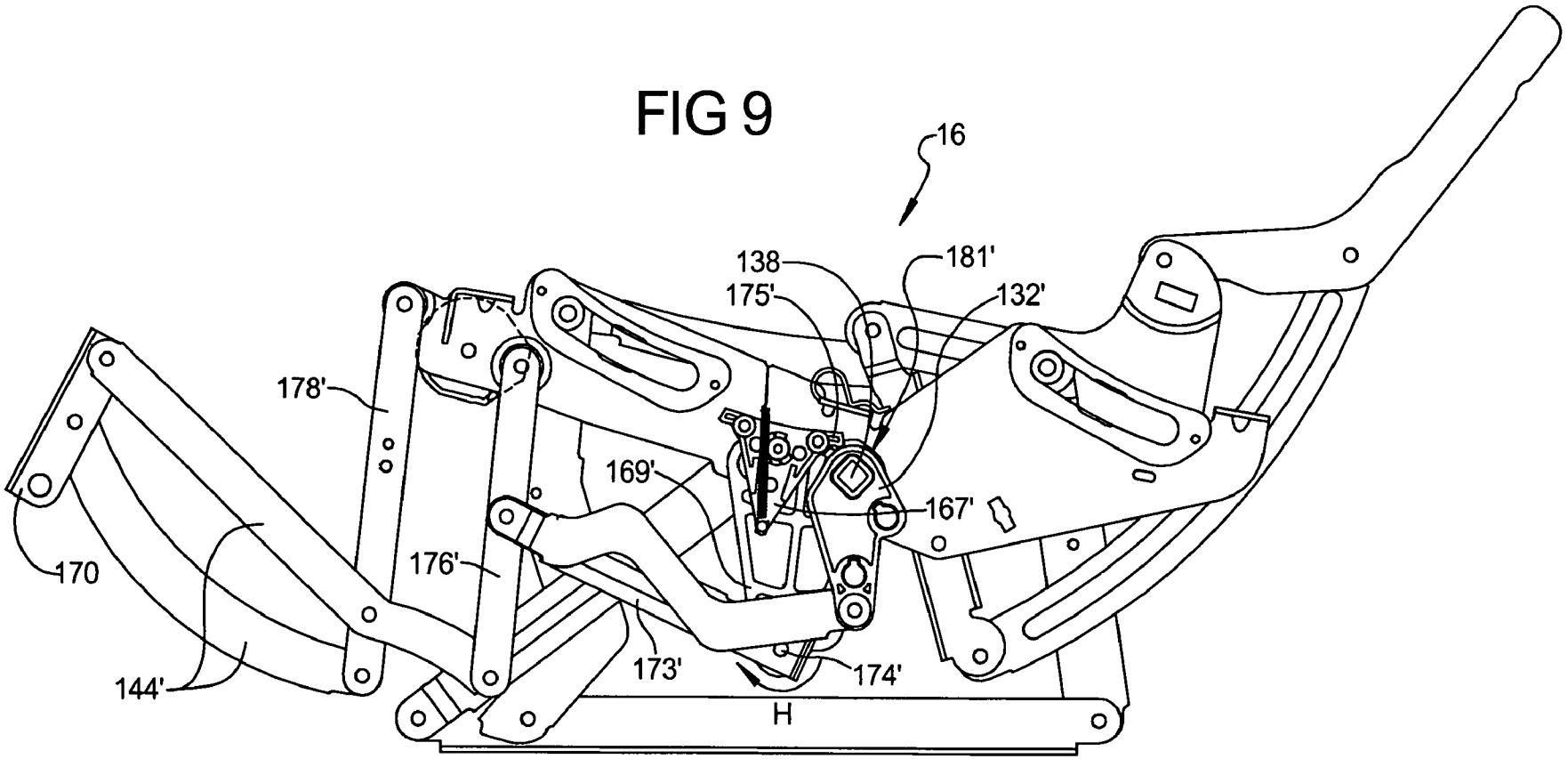
FIG. 9 is a side elevational view similar to FIG. 8, with the legrest mechanism portion partially extended.

Referring now to FIG. 9, foot rest mount plate 170 is shown in a partially extended position which results when drive rod 138 is rotated about arc of rotation "H" which displaces stop drive member 169' connected to a displacement link 173'. Displacement link 173' in turn displaces each of a substantially parallel pair of first and second foot rest motion links 176', 178'. First and second foot rest motion links 176', 178' in turn are pinned to and displace pantograph linkages 144'. Drive rod 138 rotates toggle lever 132' which in turn rotates arm 175' of stop drive link 167' (counterclockwise as viewed in FIG. 9) by contact of a curved second cam surface 181' of toggle lever 132' with arm 175'.

Figure 10:
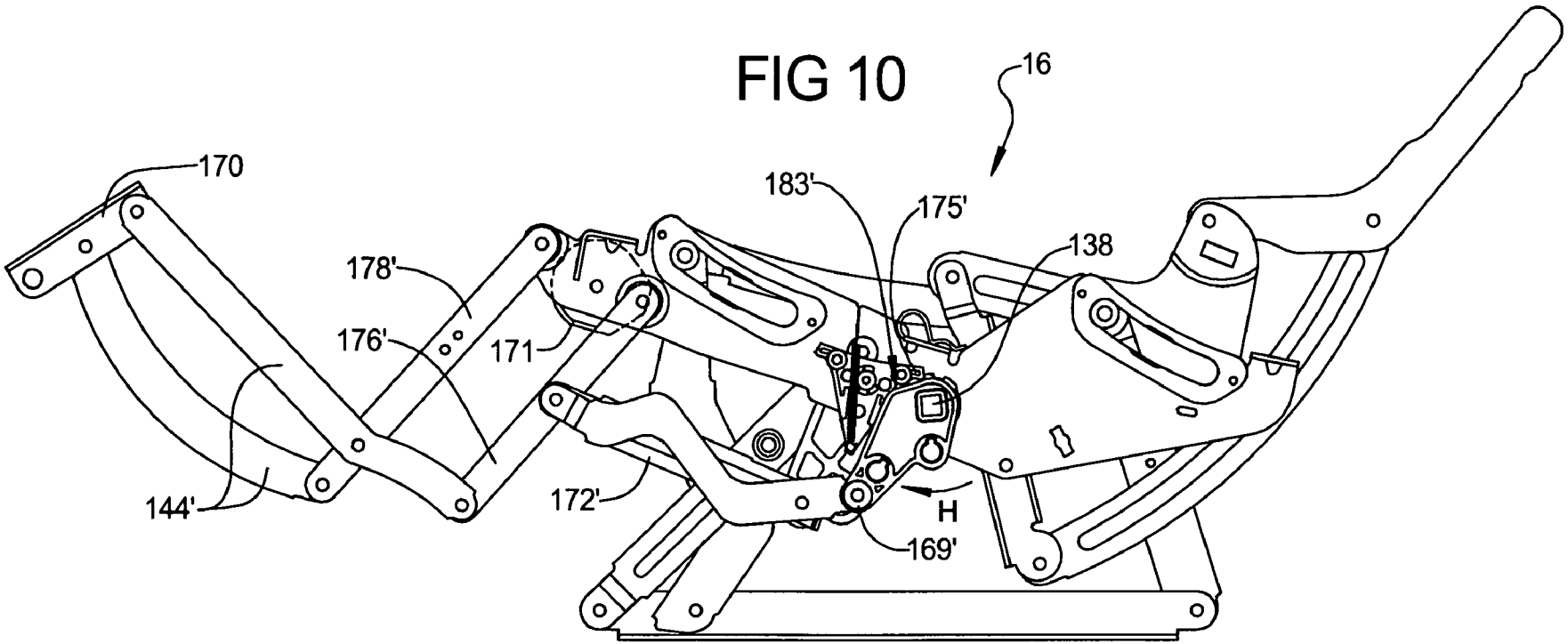
FIG. 10 is a side elevational view similar to FIG. 8, with the legrest mechanism portion approximately mid-extended.

As best seen in reference to FIG. 10, continued rotation of drive rod 138 about arc of rotation "H" further displaces foot rest mount plate 170. Drive rod 138 continues to rotate toggle lever 132' which in turn rotates arm 175' of stop drive link 167' (counterclockwise as viewed in FIG. 10) by contact with a substantially flat third cam surface 183' of toggle lever 132'.

Figure 11:
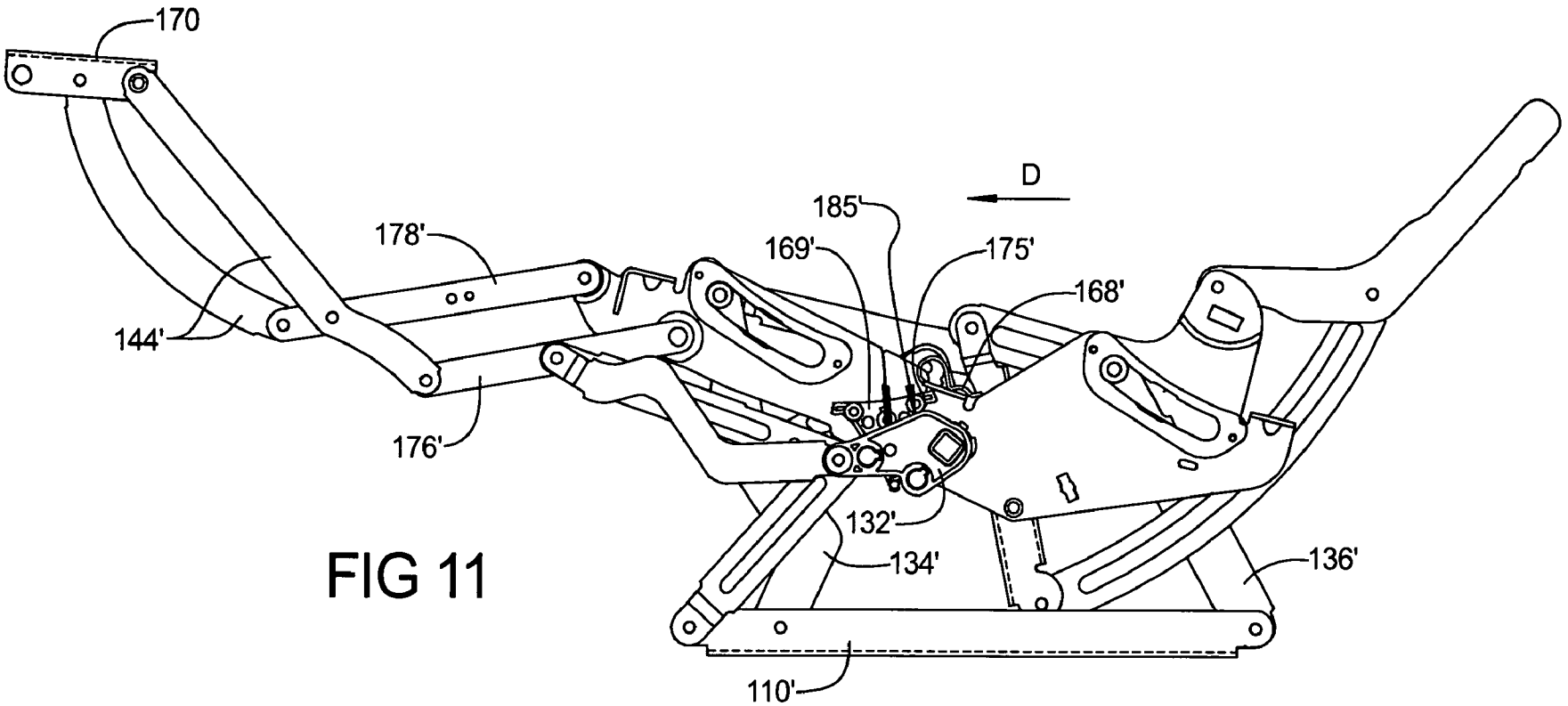
FIG. 11 is a side elevational view similar to FIG. 8, with the legrest mechanism portion fully extended.

As best seen in reference to FIG. 11, the fully extended position of foot rest mount plate 170 is reached when arm 175' of stop drive link 167' contacts rotation stop pin 168'. Toggle lever 132' rotates arm 175' of stop drive link 167' (counterclockwise as viewed in FIG. 11) by contact with a substantially flat fourth cam surface 185' of toggle lever 132' which forces arm 175' into contact with stop pin 168', preventing further rotation of stop drive link 167', toggle lever 132' and drive rod 138. At the fully extended position, forward and rear support links 134', 136' have rotated with respect to mechanism support member 110' allowing mechanism 16 to fully translate in the translation direction Referring now to FIG. 12, when rocking reclining chair 10 is in the fully upright position having forward and rear support links 134, 136 in their substantially upright position shown, the forward and rear support links 134, 136 are co-rotatably connected using a cross link 180 pinned at opposite ends using first and second motion pins 156, 158. A first cross brace 182 is connected between forward support links 134, 134' and a second cross brace 184 is similarly connected between each of the rear support links 136, 136'. In several embodiments, a ratchet 186 is fixedly connected to first cross brace 182. Ratchet 186 provides a plurality of teeth 188. In the fully upright position shown, the ratchet engaging end 104 of pawl 98 does not contact any of teeth 188.

Figure 12:
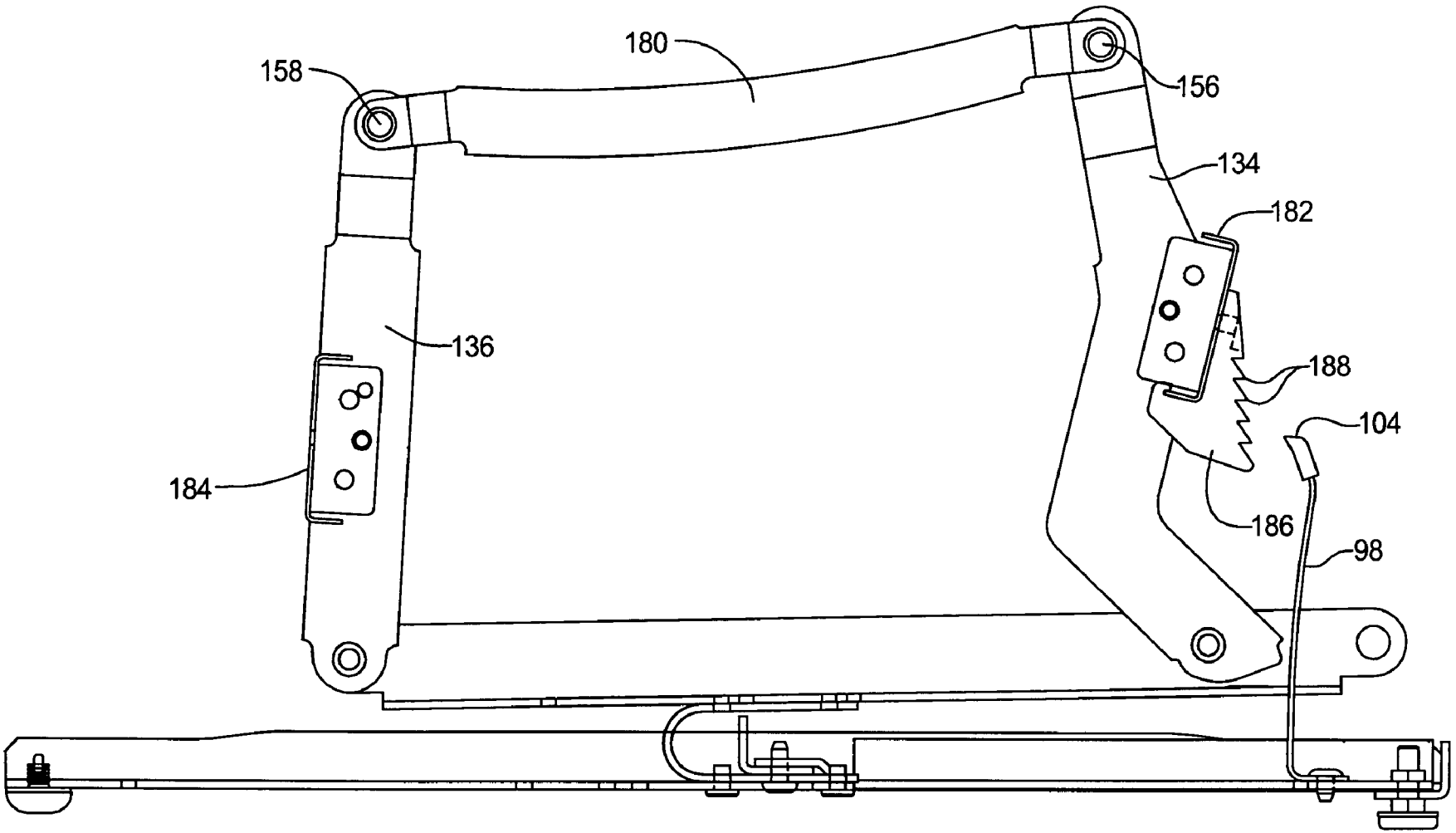
FIG. 12 is a side elevational view of a portion of the mechanism in the fully upright position and disengaged from the pawl.
Figure 13:
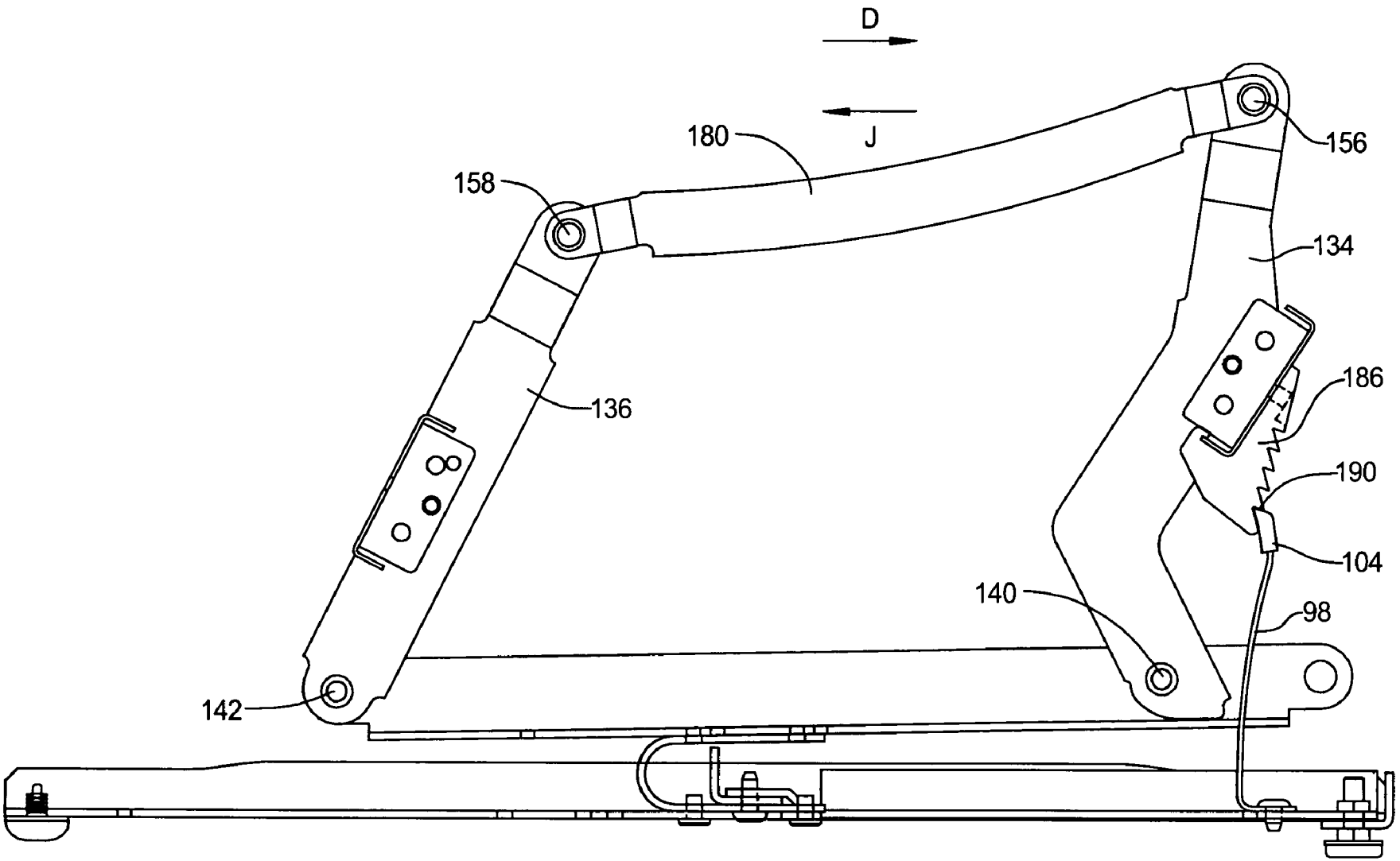
FIG. 13 is a side elevational view similar to FIG. 12 of the portion of the mechanism in the legrest extended position having the pawl engaged with the ratchet.

Referring now to FIG. 13, as foot rest panel 68 is extended and each of forward and rear support links 134, 136 rotate about first and second pinned joints 140, 142, cross link 180 together with forward and rear support links 134, 136 are repositioned in the translation direction "D" which moves ratchet 186 to the right as shown in FIG. 13 until ratchet engaging end 104 of pawl 98 engages in a first engagement position 190 between any first two of the teeth 188. Engagement of ratchet engaging end 104 in the first engagement position 190 helps retain foot rest panel 68 in the extended position. Disengagement of ratchet engaging end 104 and return to the position shown in FIG. 12 is accomplished by rearward rotation of forward and rear support links 134, 136 and movement of cross link 180 substantially in a return direction "J". While in the leg rest extended position, further backward rotation of foot rest panel 68 will reposition ratchet engaging end 104 between any subsequent pair of the teeth 188 which retains the foot rest panel 68 at multiple, increasing elevations with respect to a floor or support surface.

Figure 14:
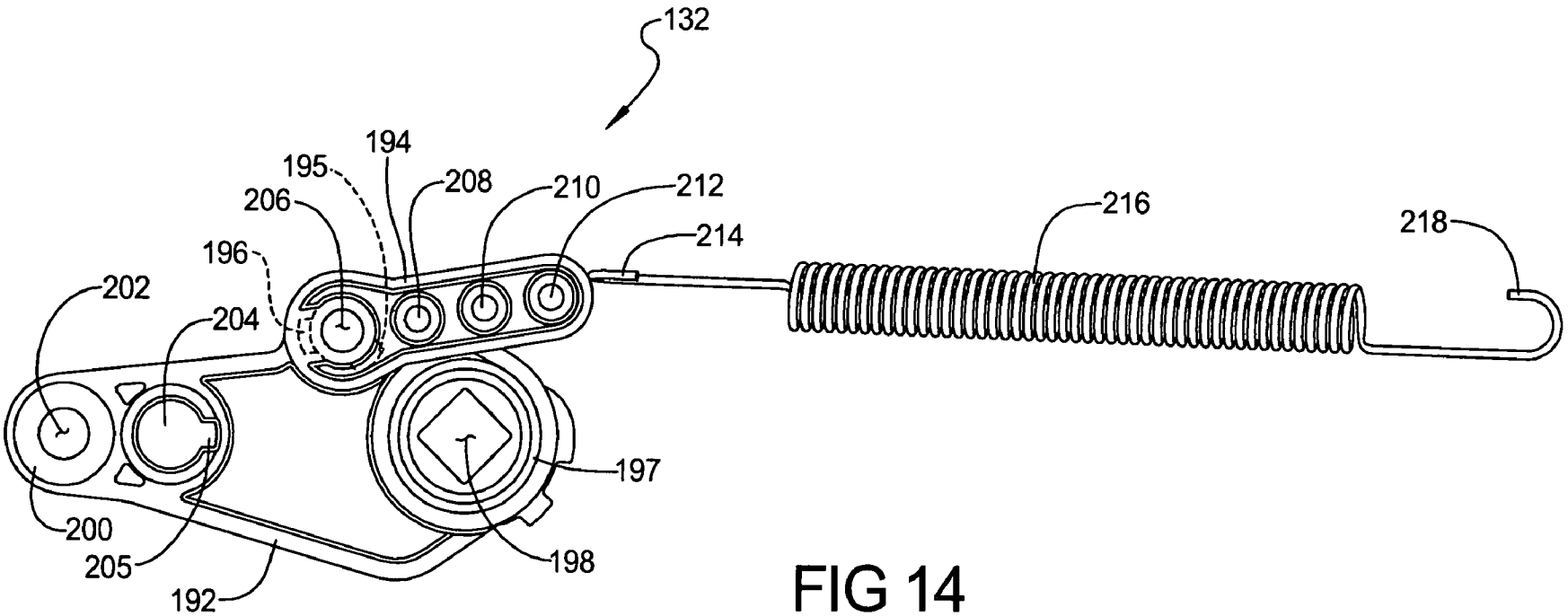
FIG. 14 is a side elevational view of a toggle lever and biasing element of the present disclosure.

As best seen in reference to FIG. 14, toggle lever 132 includes a toggle body 192 to which is connected a toggle extension 194. This is accomplished by aligning a male tab 195 of toggle extension 194 with a female slot 196 of toggle body 192 and rotating toggle extension 194 to the position shown. Toggle extension 194 is thereafter prevented from dislocation from toggle body 192 unless and until male tab 195 is rotated to re-align with female slot 196. Toggle body 192 further includes a first bearing member 197 having a substantially rectangular aperture 198 created therein. Rectangular aperture 198 receives drive rod 138. A second bearing member 200 includes a circular aperture 202. A keyed aperture 204 having a female slot 205 similar to female slot 196 is provided for an alternate installation location of toggle extension 194 for embodiments having rocking reclining chair 10 operated by a latch release mechanism (not shown). Toggle extension 194 includes multiple apertures including a first adjustment aperture 208, a second adjustment aperture 210 and a third adjustment aperture 212. Adjustment apertures 208, 210 and 212 are adapted to receive a first hooked end 214 of a biasing element 216. A second hooked end 218 of biasing element 216 is connected to structure extending from connecting plate 150. By positioning first hooked end 214 in any one of the first, second or third adjustment apertures 208, 210, or 212 an over-center biasing force can be either increased or decreased which affects the amount of torque applied to drive rod 138 to release mechanism 16 from the fully upright position and into for example the leg rest extended position.

Figure 15:
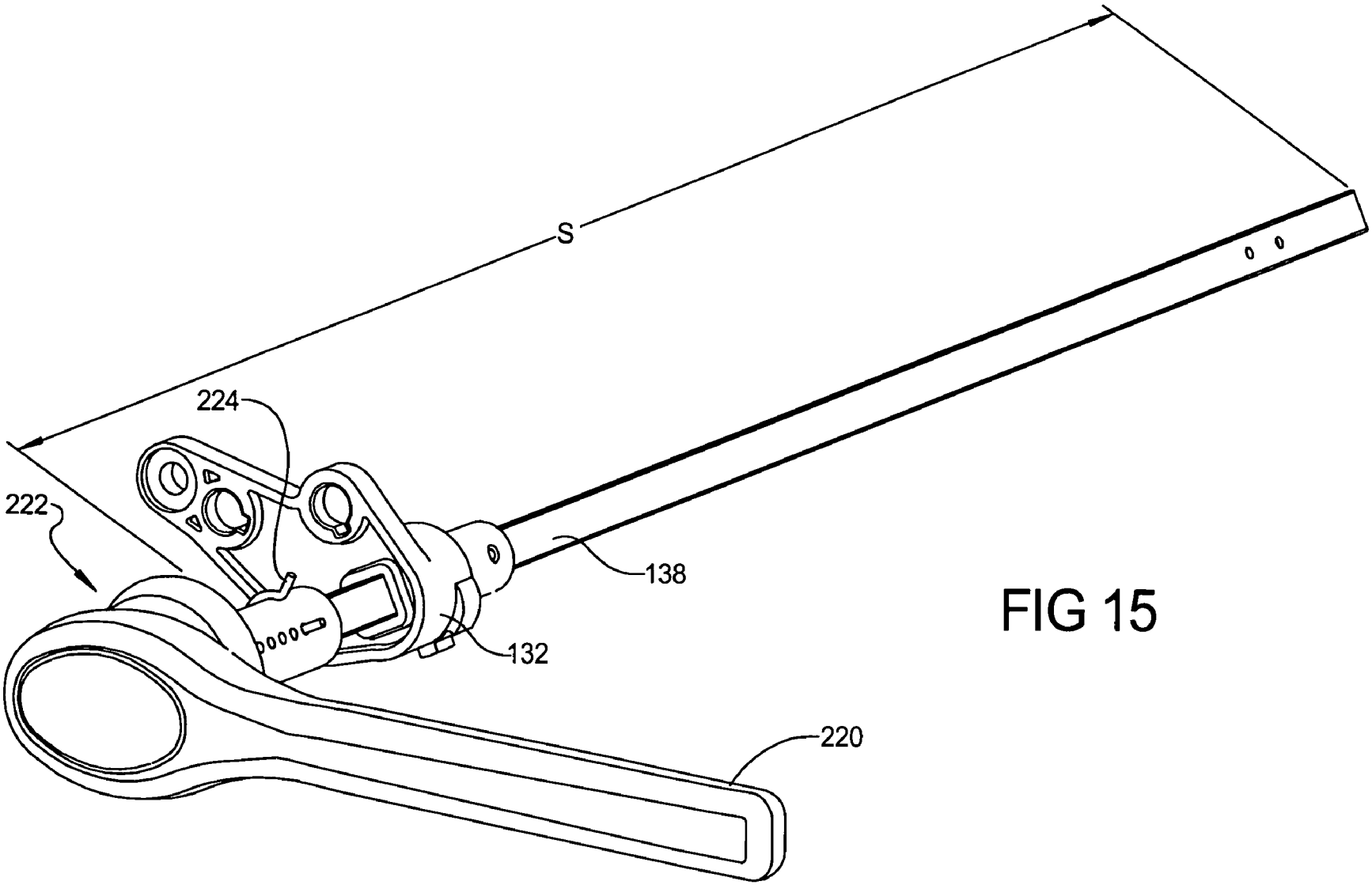
FIG. 15 is perspective view of an assembly of a handle, escutcheon, and toggle lever onto a drive rod of the present disclosure.

As best seen in reference to FIG. 15, toggle lever 132 is shown as it is nominally positioned on drive rod 138. At one end of drive rod 138 a handle 220 is connected which is used to manually rotate drive rod 138 to either release or engage mechanism 16 in either the extended or retracted positions. Handle 220 is connected to an escutcheon 222. Escutcheon 222 can be positioned along various locations of drive rod 138 to allow a single drive rod 138 to be used in multiple width embodiments of rocking reclining chair 10. A releasable pin 224 is provided to engage escutcheon 222 with drive rod 138. A total length or spacing "S" of the assembly is determined by the location that releasable pin 224 is placed. The ability to control spacing "S" provides the manufacturer the option to multiple assemblies of the handle 220, escutcheon 222, and drive shaft 138 which allows the same parts to be used in furniture members having a plurality of widths.

Figure 16:
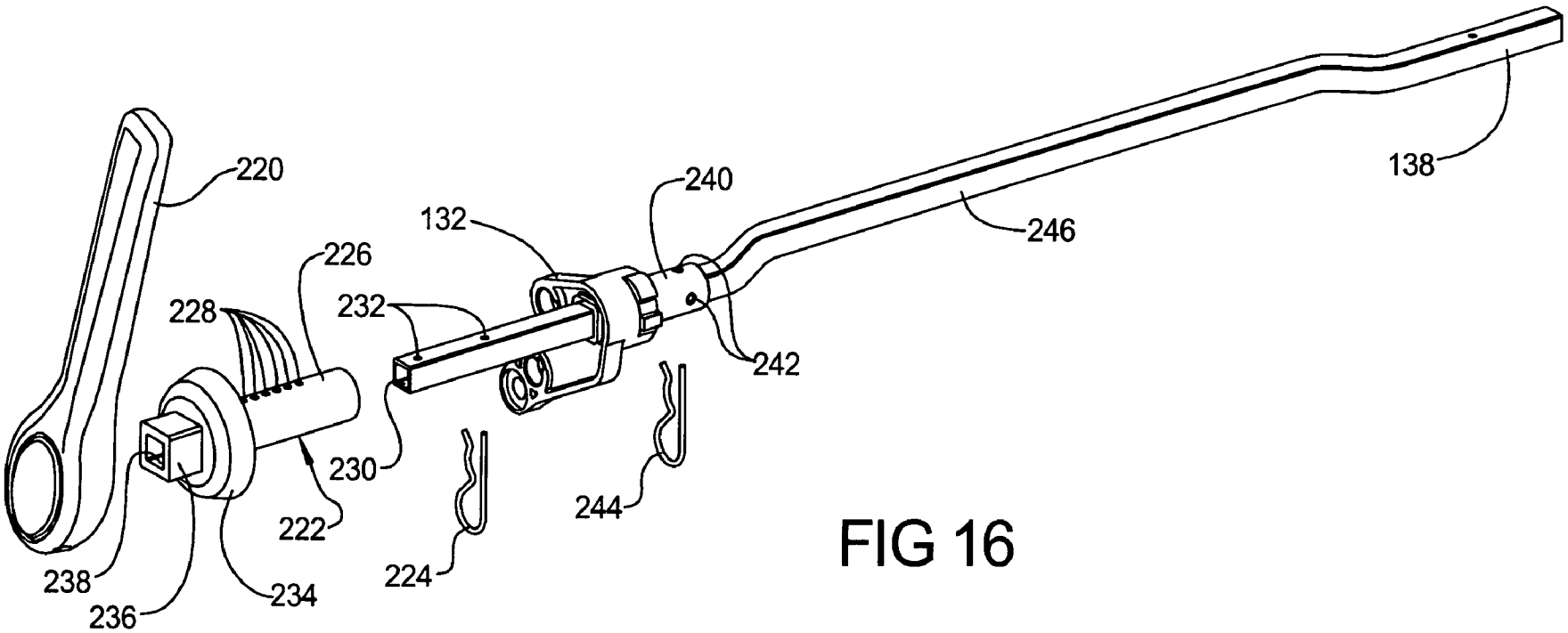
FIG. 16 is an exploded assembly view of the configuration of FIG. 15.

Referring now generally to FIG. 16, for adjusting both toggle lever 132 and escutcheon 222 on drive rod 138, a tubular portion 226 of escutcheon 222 includes a plurality of apertures 228. Each of the apertures 228 are created as opposed pairs having an alternate or secondary one of the apertures oppositely positioned (not visible in this view) about tubular portion 226. Drive rod 138 includes an escutcheon engagement end 230 having at least one and in several embodiments a plurality of pin alignment apertures 232. To engage escutcheon 222 on drive rod 138 the tubular portion 226 is slidably disposed over the escutcheon engagement end 230 until one of the plurality of apertures 228 aligns with one of the pin alignment apertures 232. Releasable pin 224 is then inserted through the aligned ones of apertures 228 and pin alignment apertures 232 to releasably engage escutcheon 222.

Escutcheon 222 further includes a skirt 234 having a diameter large enough to visually cover an aperture created through upholstered sections of rocking reclining chair 10 necessary for insertion of tubular portion 226. An engagement drive end 236 is created in several embodiments by co-molding engagement drive end 236 with skirt 234. Engagement drive end 236 includes a substantially rectangular drive rod receiving through aperture 238 which is sized to correspond to the geometry of drive rod 138 and to provide external dimensions which are suitable for engaging engagement drive end 236 with handle 220.

Toggle lever 132 further includes a toggle tube portion 240 which also includes at least one and in several embodiments a plurality of tube apertures 242 which are aligned with corresponding apertures of drive rod 138. A second releasable pin 244 is thereafter received in the aligned ones of tube apertures 242 through toggle tube portion 240 and the corresponding tube apertures of drive rod 138. According to several embodiments drive rod 138 can also include a generally U-shaped portion 246. U-shaped portion 246 is provided in several embodiments to increase a clearance below the first and second plurality of flat springs 114, 116 which support the occupant of rocking reclining chair 10 when a weight of an occupant downwardly deflects the flat springs 114, 116, and to provide clearance for motion of the first pair of forward link members 134, 134' and the second pair of rear link members 136, 136', as well as any other moving elements of mechanism 16.

As best seen in reference to both FIGS. 17 and 18, installation of handle 220 on escutcheon 222 proceeds as follows. Engagement drive end 236 is provided with at least one sloped engagement tooth 248 which includes a raised edge 250 facing skirt 234. Sloped engagement tooth 248 can be provided on at least one of the flat faces created on the substantially rectangularly shaped engagement drive end 236. An engagement drive end receiving portion 251 of handle 220 receives the generally rectangularly shaped engagement drive end 236 in a correspondingly sized and shaped engagement drive aperture 252 created in receiving portion 251. To insert handle 220 onto escutcheon 222, a pitched alignment slot 254 aligned with and directed toward engagement drive aperture 252 is aligned with sloped engagement tooth 248. Handle 220 is engaged with engagement drive end 236 by displacement in a handle attachment direction "K". Thereafter, handle 220 is pressed or hammered to drive sloped engagement tooth 248 past pitched alignment slot 254 until the raised edge 250 and sloped engagement tooth 248 engage within a tooth engagement aperture 256 also created with the engagement drive aperture 252, defining a snap fit. Sloped engagement tooth 248 is designed to elastically and not permanently deflect during installation so raised edge 250 can thereafter provide a retention capability to prevent handle 220 from being removed from engagement drive end 236. This snap fit connection is therefore intended to be a substantially permanent connection, however the skilled practitioner will recognize that a sufficient force can be applied to remove handle 220 if desired.

Figure 19:
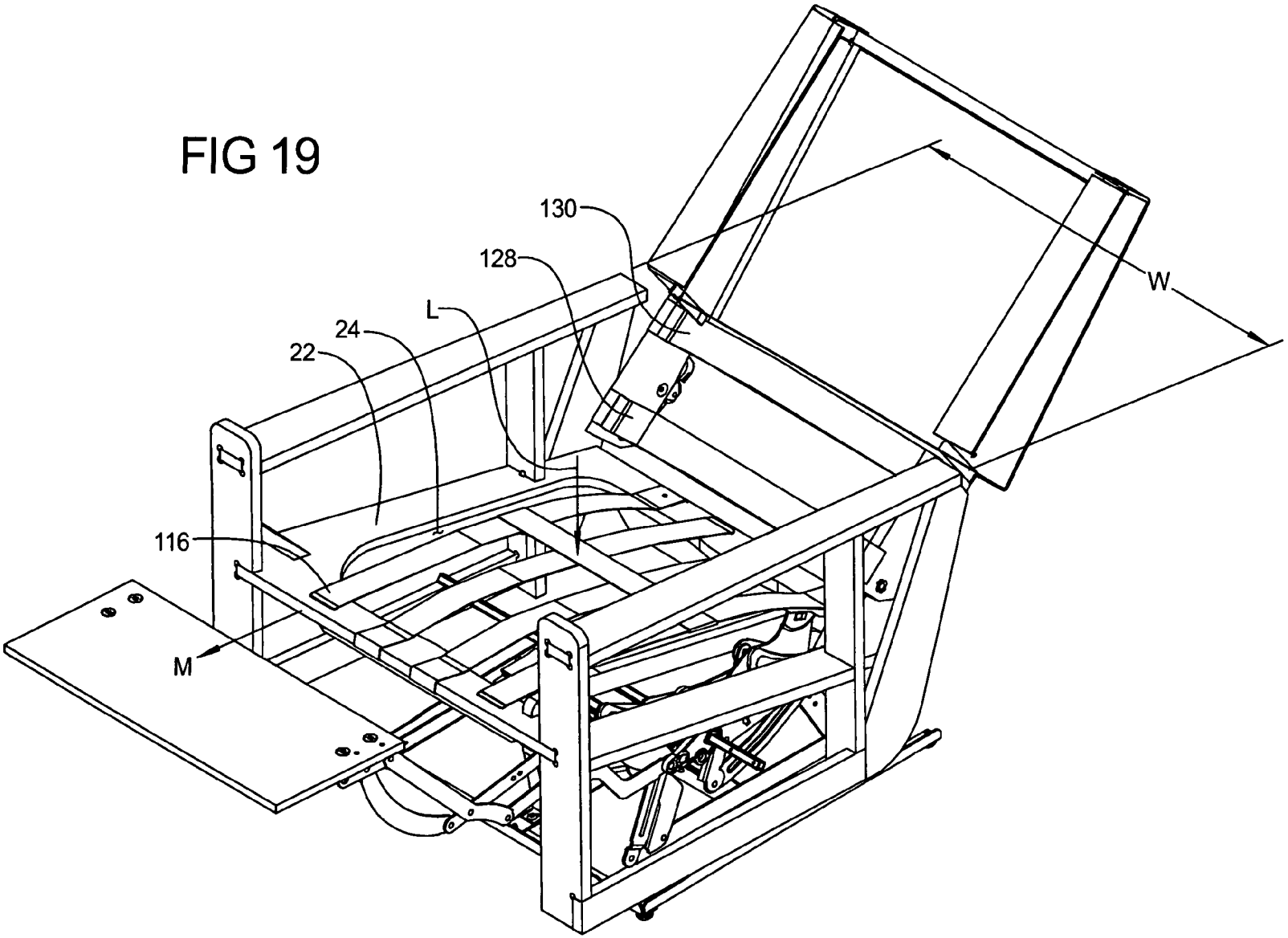
FIG. 19 is a front perspective view showing the chair of FIG. 1 in the legrest and backrest fully extended positions.

Referring now to FIG. 19, the weight of an occupant displaces first and second flat springs 114 and 116 in a downward direction "L". The free ends 120, 124 of flat springs 114, 116 initially deflect in the downward direction "L" until they contact seat pan 22. Thereafter, the free ends 120, 124 can longitudinally displace, in sliding contact with seat pan 22. For example the free ends 124 of flat springs 116 displace in a forward direction "M". The free ends 120 of flat springs 114 will oppositely displace. Flat springs 114 and 116 can also deflect into clearance aperture 24 of seat pan 22, creating greater weight bearing capacity for chair 10.

Figure 20:
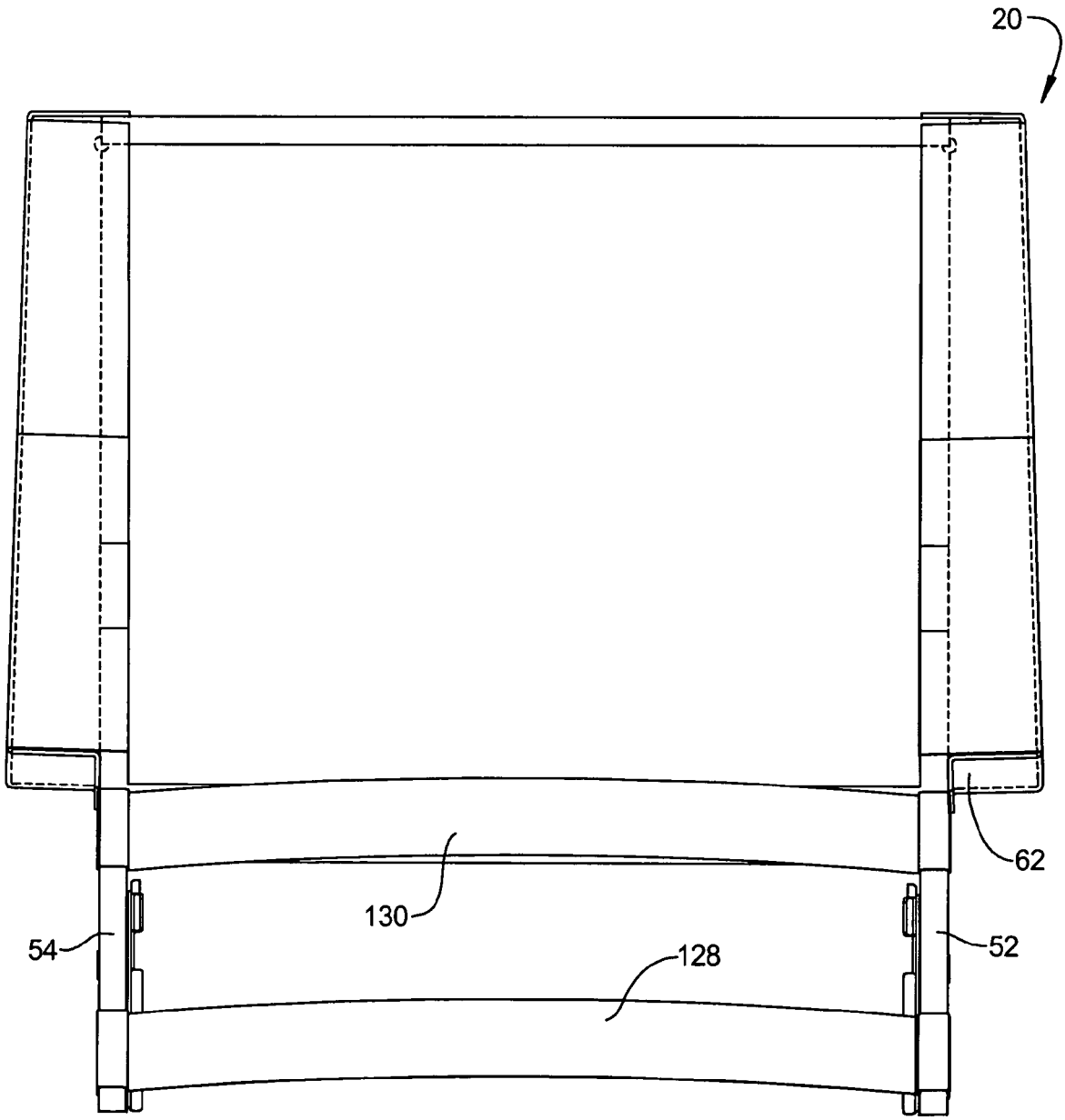
FIG. 20 is a rear elevational view of the back frame of the chair of FIG. 1.

Referring now generally to FIG. 20, back frame 20 is viewed from a rear side looking forward. From this orientation it is evident that first and second lumbar flat springs 128, 130 can be created having a curved geometry, and in the example shown the curved geometry presents an upwardly directed arc whose tangent is greatest at the center location positioned between the connecting points of each of first and second lumbar flat springs 128, 130 with their connections at first and second back braces 52, 54. In several additional embodiments, first and second lumbar flat springs 128, 130 can also be substantially straight or can be curved in an opposite orientation from that shown.

Figure 21:
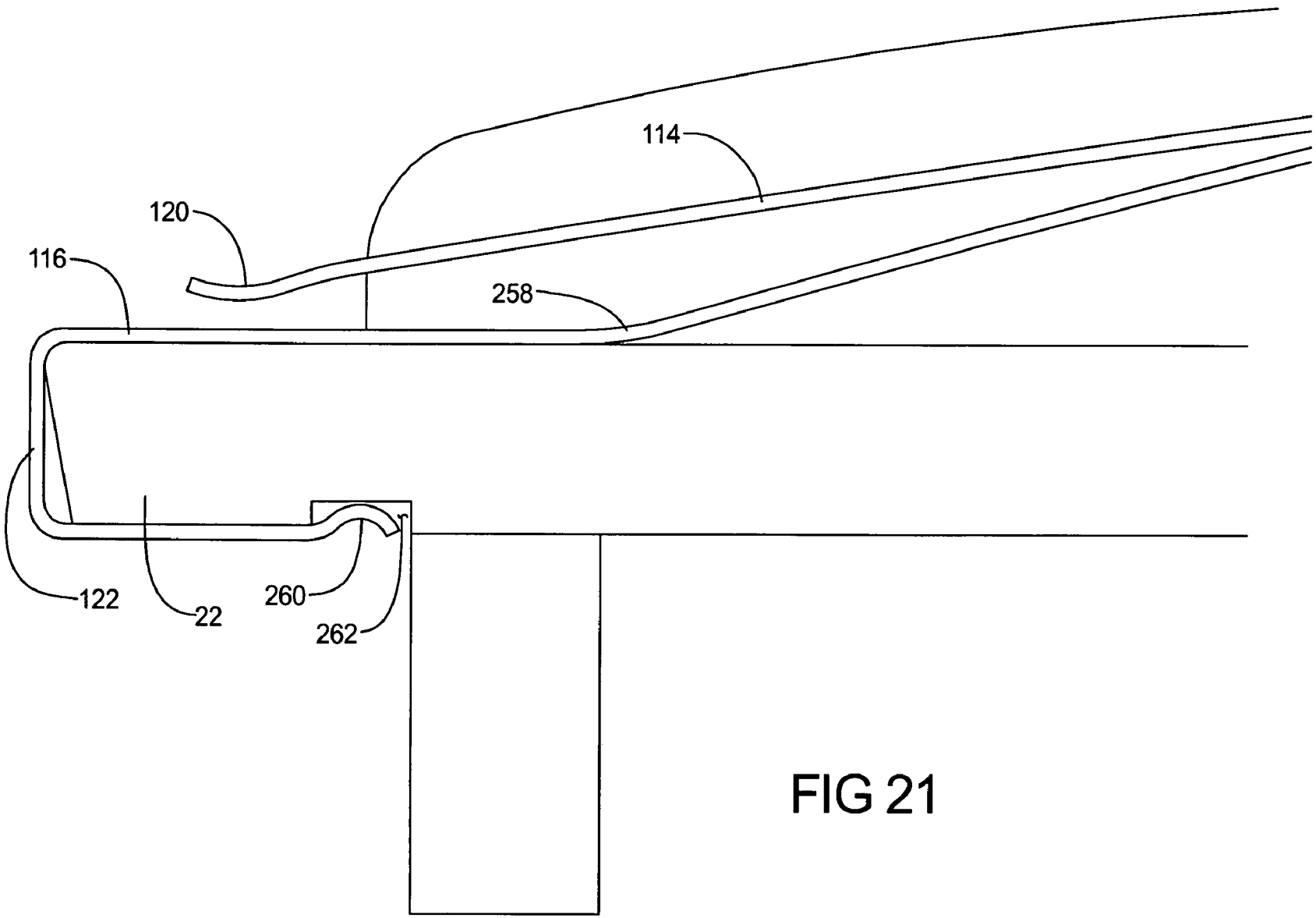
FIG. 21 is a partial elevational view taken at view 21 of FIG. 3.

Referring now to FIG. 21, first and second flat springs 114, 116 each include a bend location 258. Bend locations 258 transition the curving portion of the spring body used for support of the occupant into a flattened portion of the spring positioned proximate to the looped ends. Only looped end 122 is shown for first flat springs 116. Flat springs 114 are oppositely installed. The looped end 122 turns a portion of the spring to face substantially forward and below seat pan 22. A curved portion or detent 260 is created defining an engagement end of each of the first and second flat springs 114, 116. Each detent 260 is received within a detent cavity 262 created in seat pan 22. Because the width across looped ends 118 and 122 is substantially equal to a thickness of seat pan 22, an elastic spring force is created when detents 260 are pressed over the ends of seat pan 22. This spring force initially displaces and thereafter retains the detents 260 in the detent cavities 262 to resist removal of the flat springs. Each of the free ends 120, 124 is defined by a concavely upward curving portion which when abutted with seat pan 22 under the weight of the occupant allows the flat springs to longitudinally lengthen and displace along a plane defined by the upward facing surface of seat pan 22. This sliding motion of the spring free ends occurs as the springs deflect when loaded with the occupant's weight, and as the springs return to the unloaded or freely extending position shown in FIG. 21 when the weight of the occupant is removed.

Figure 22:
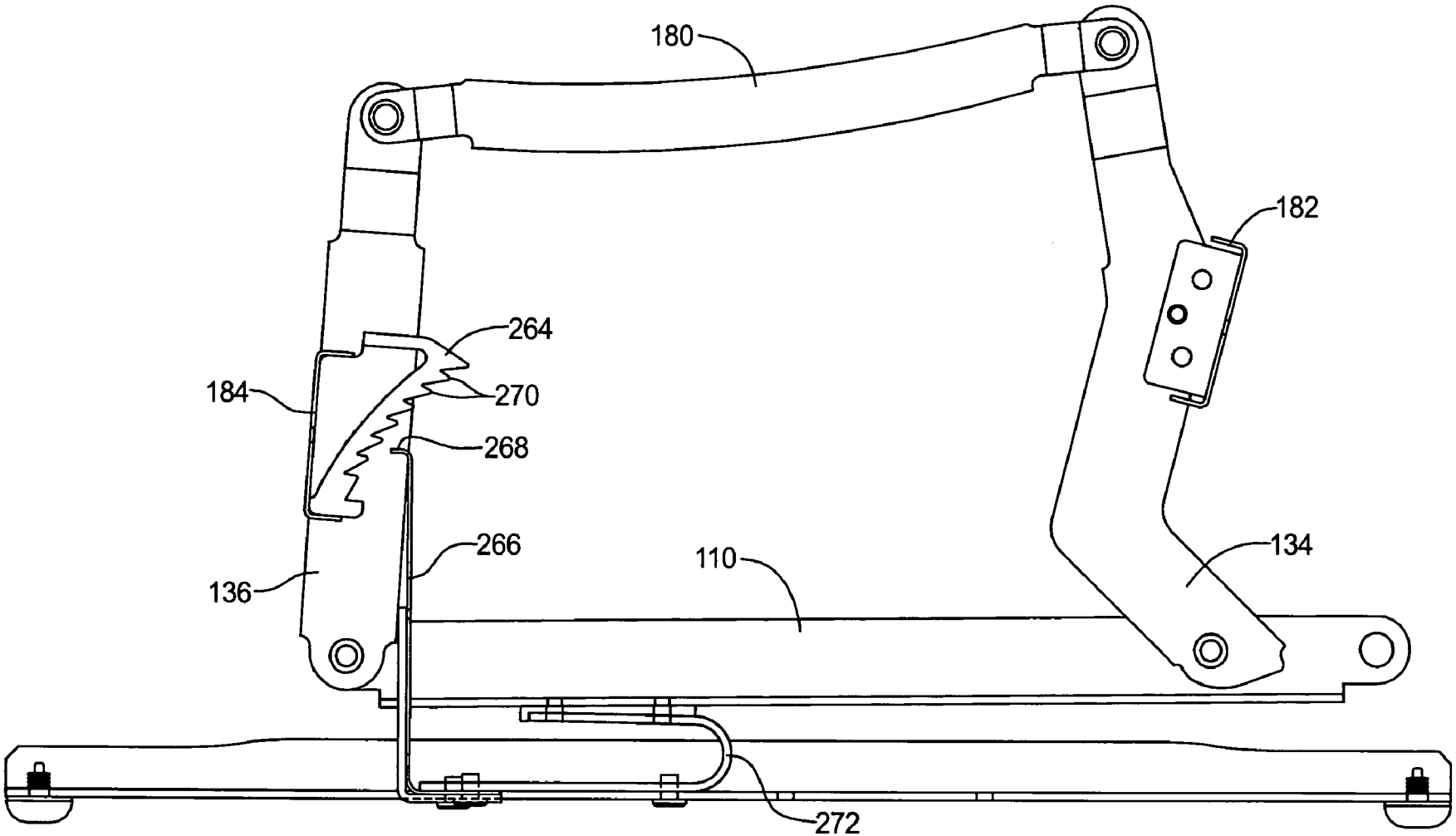
FIG. 22 is a side elevational view similar to FIG. 12 of another embodiment of ratchet and pawl design.

Referring now generally to FIG. 22, in several embodiments, a ratchet 264 and pawl 266 are modified from ratchet 186 and pawl 98. Pawl 266 includes a rearwardly facing catch end 268. Ratchet 264 includes a plurality of upwardly directed teeth 270, which are oppositely oriented with respect to the generally downwardly directed teeth 188 of ratchet 186. Also provided in this view is an extended length U-shaped leaf spring 272, which replaces both first and second U-shaped leaf springs 88, 90 with a single leaf spring. Leaf spring 272 also eliminates the need for stiffener brace 92 and attachment brace 94 of FIG. 2.

Figure 23:
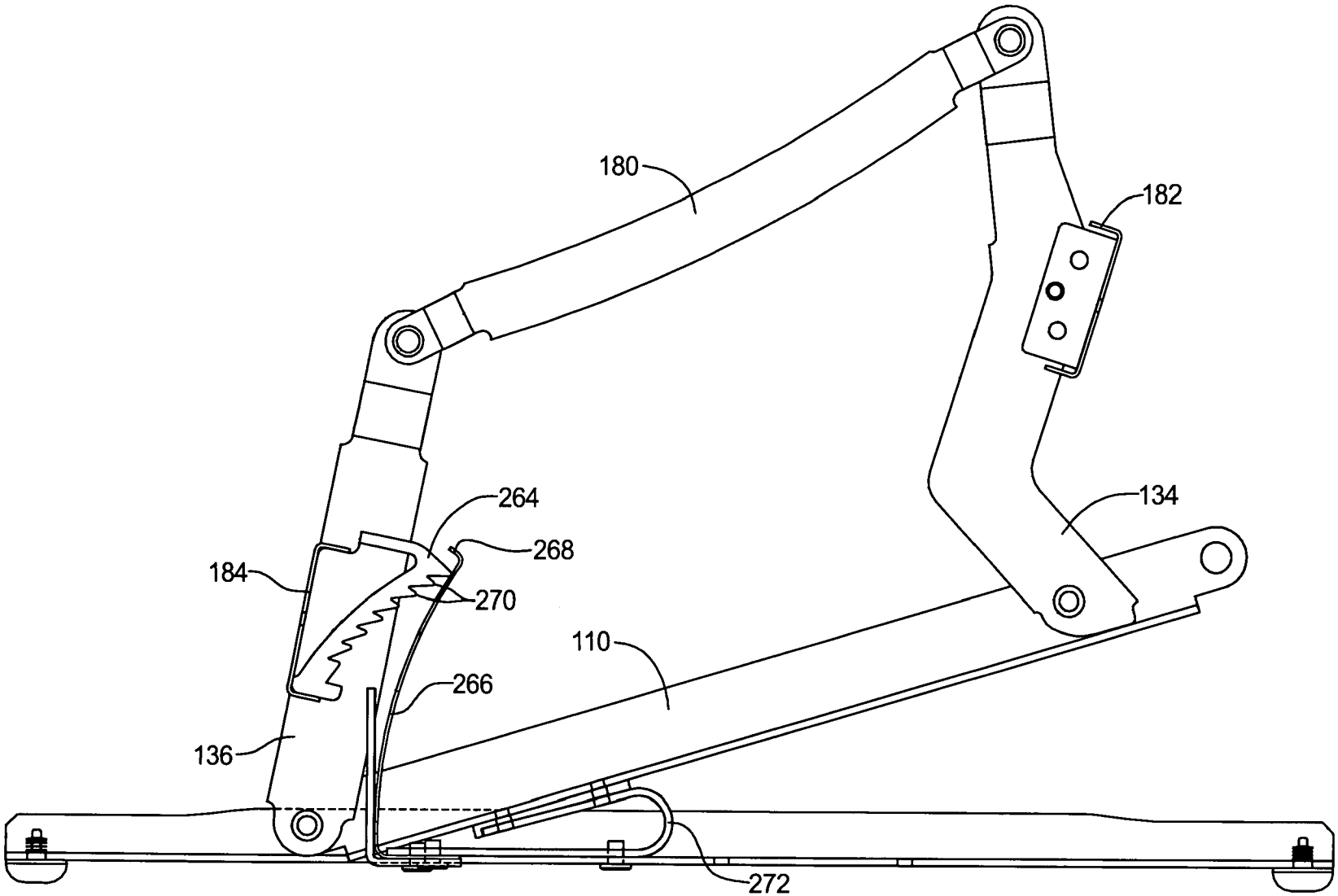
FIG. 23 is the side elevational view of FIG. 22, with the chair rotated rearwardly.

With reference to FIG. 23, a rearward rocking motion of chair 10 about leaf spring 272 does not result in contact between catch end 268 and teeth 270. Pawl 266 is retained in the non-engaged, non-deflected condition. Catch end 268 does not engage teeth 270 because forward and rear support links 134, 136 do not rotate as chair 10 rocks rearwardly about leaf spring 272.

Figure 24:
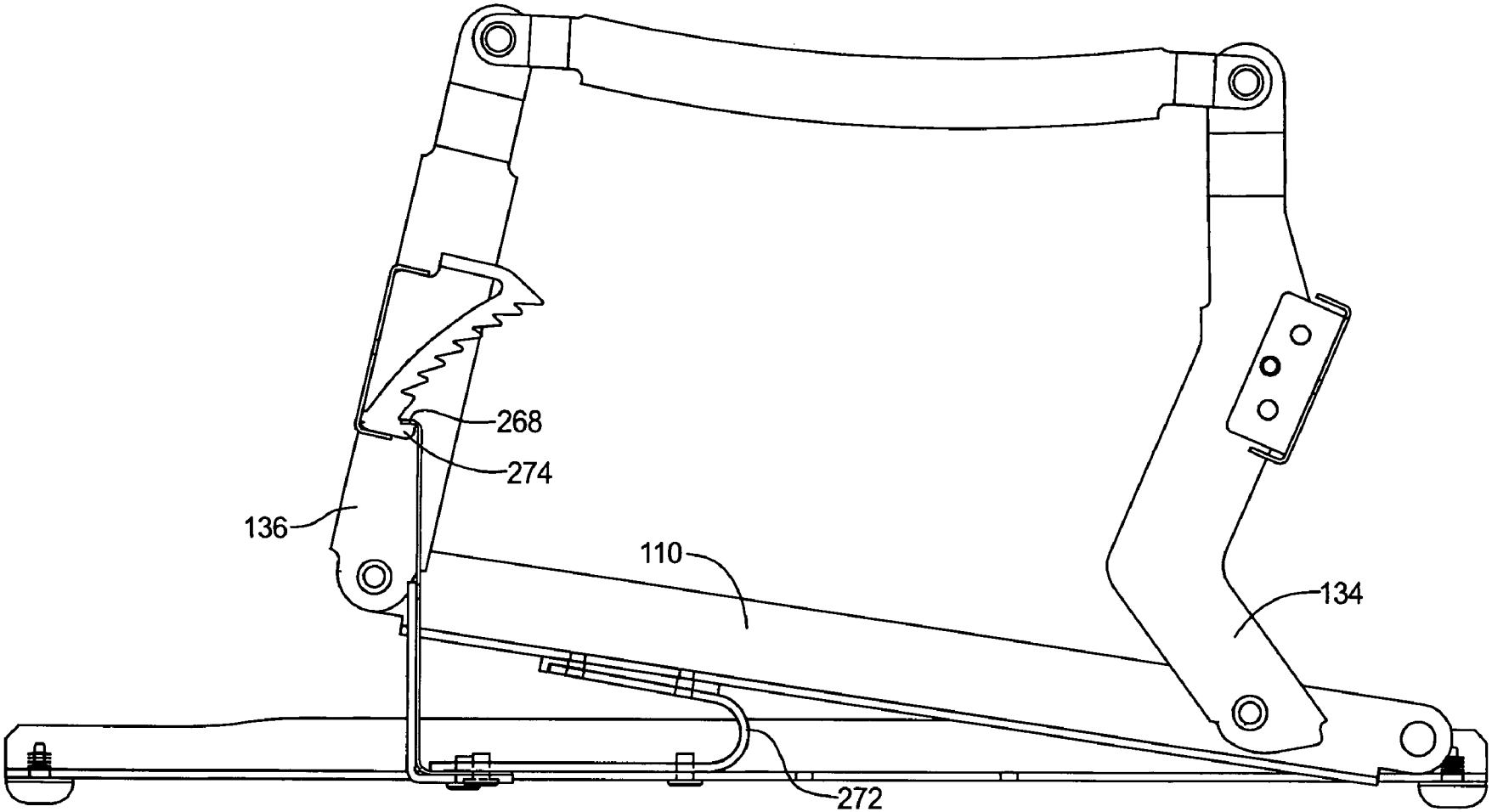
FIG. 24 is the side elevational view of FIG. 22, with the chair rotated forwardly.

With reference to FIG. 24, a forward rocking motion of chair 10 about leaf spring 272 also does not result in contact between catch end 268 and any of teeth 270, however, catch end 268 can contact a ledge 274 created in ratchet 264. Engagement of catch end 268 with ledge 274 provides a positive stop to further forward rotation of chair 10. Catch end 268 does not engage teeth 270 during forward rocking motion because forward and rear support links 134, 136 do not rotate as chair 10 rocks forwardly about leaf spring 272.

Figure 25:
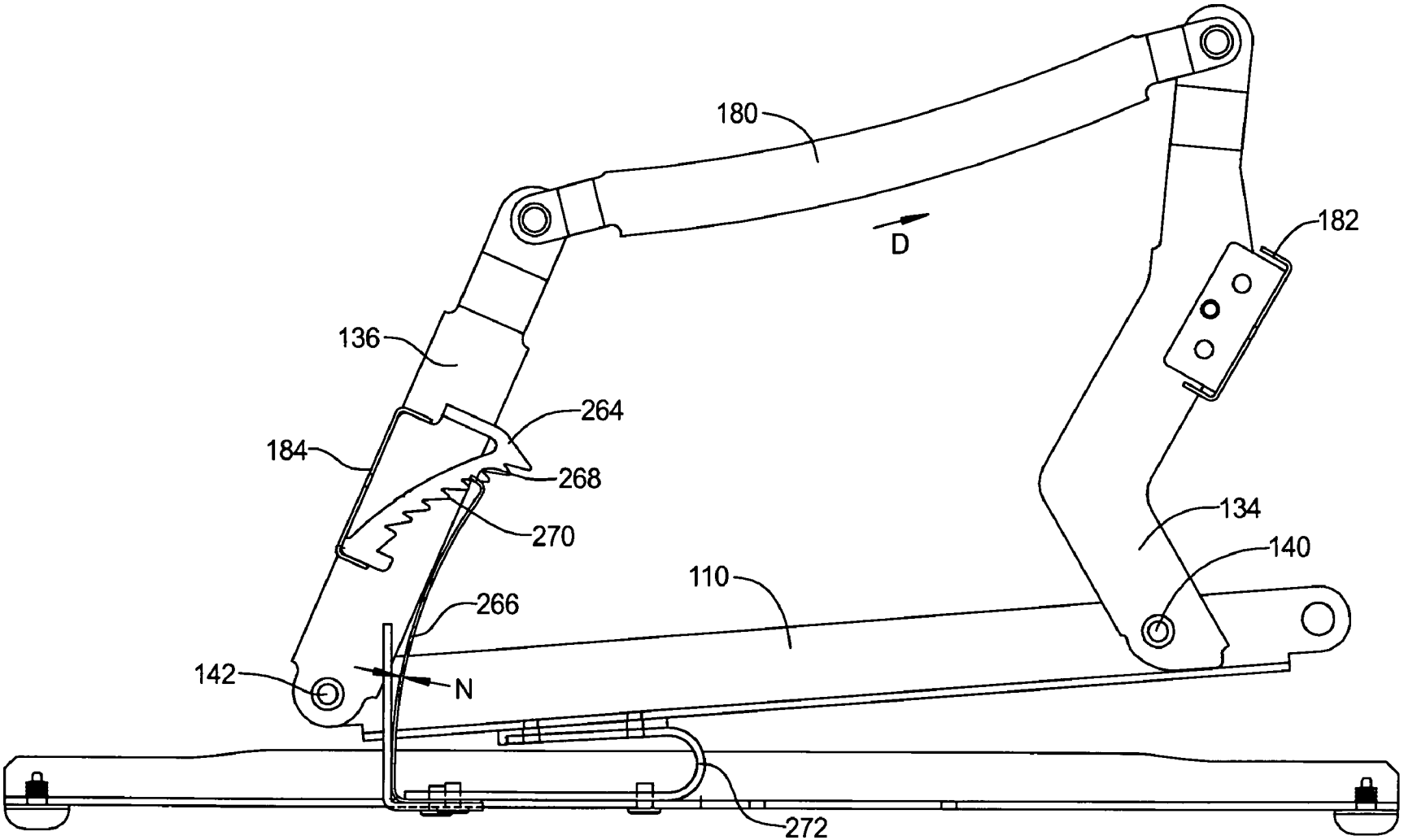
FIG. 25 is the side elevational view of FIG. 22, with the legrest extended, resulting in rotation of the mechanism and engagement of the pawl.

Referring now to FIGS. 13 and 25, as the leg rest of chair 10 is extended outwardly, forward and rear support links 134, 136 (as well as links 134' and 136' not visible in this view) rotate about first and second pinned joints 140, 142 in a clockwise direction as viewed in FIG. 25. Cross link 180 and ratchet 264 effectively translate in translation direction "D" which positions teeth 270 for engagement by catch end 268. Further movement in translation direction "D" deflects pawl 266 as shown, placing pawl 266 in tension. This operation is opposite to the operation of ratchet 186 and pawl 98, wherein pawl 98 is placed in compression when teeth 188 of ratchet 186 engage attachment end 100. Because pawl 266 operates in tension, a body thickness "N" of pawl 266 can be reduced relative to a corresponding body thickness of pawl 98. This reduces weight and cost of pawl 266.

Figure 26:
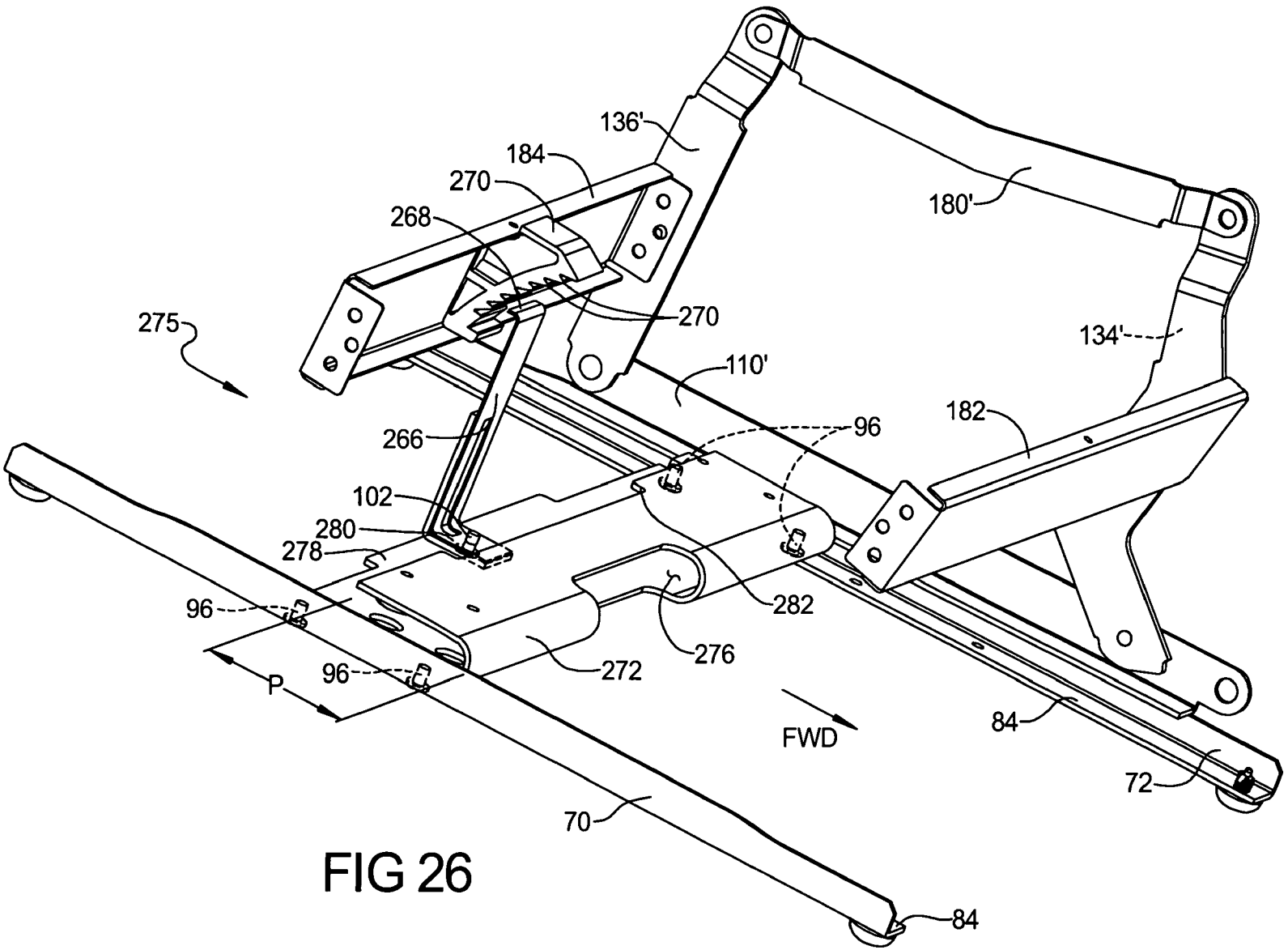
FIG. 26 is a perspective view of another embodiment of a base frame modified from the base frame of FIG. 2.

Referring now in general to FIGS. 2 and 26, in several embodiments, a base frame 275 is modified from base frame 14. Use of U-shaped leaf spring 272 in base frame 275 permits the elimination of first cross channel 74, stiffener brace 92, and attachment brace 94 from the configuration of base frame 14 (shown in FIG. 2). A width "P" of leaf spring 272 is greater than first and second leaf springs 88 and 90, thereby increasing torsional strength and resistance to fore/aft deflection of leaf spring 272, permitting elimination of the above described items. A spring cavity 276 faces rearwardly or opposite to the corresponding spring cavities of springs 88, 90. Leaf spring 272 can further include a spring extension flange 278 which provides additional support surface area for installation of a mounting flange 280 of pawl 266 using pawl mount fastener 102. Leaf spring 276 can also be connected to each of the second flanges 84 of first and second side channels 70, 72 using fasteners 96. A cut-out area 282 can be provided as necessary for additional deflection clearance for pawl 266. In operation, leaf spring 272 permits both forward and rearward rocking or rotation of chair 10.

Figure 27:
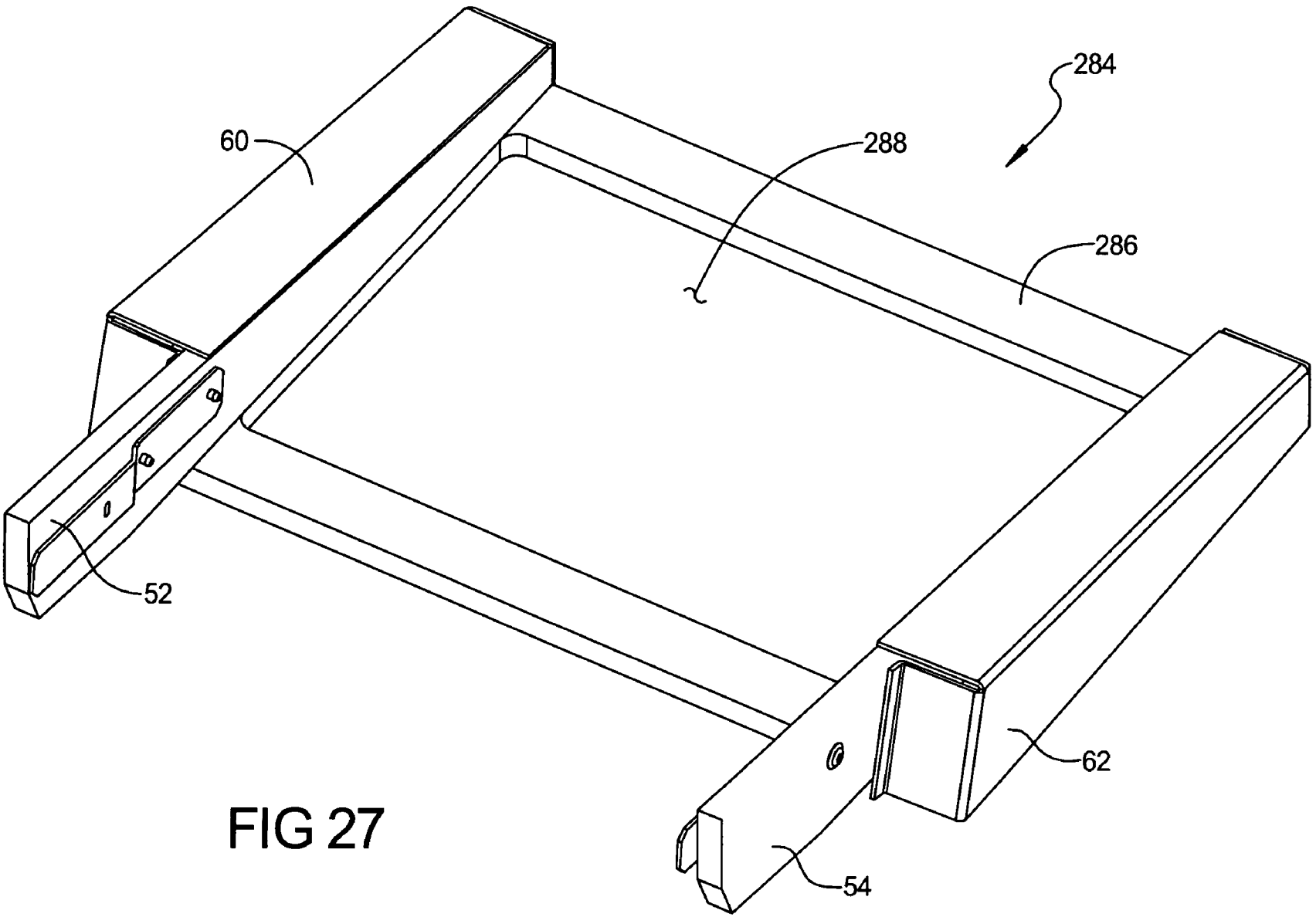
FIG. 27 is a perspective view of another embodiment of a back frame.
Figure 28:
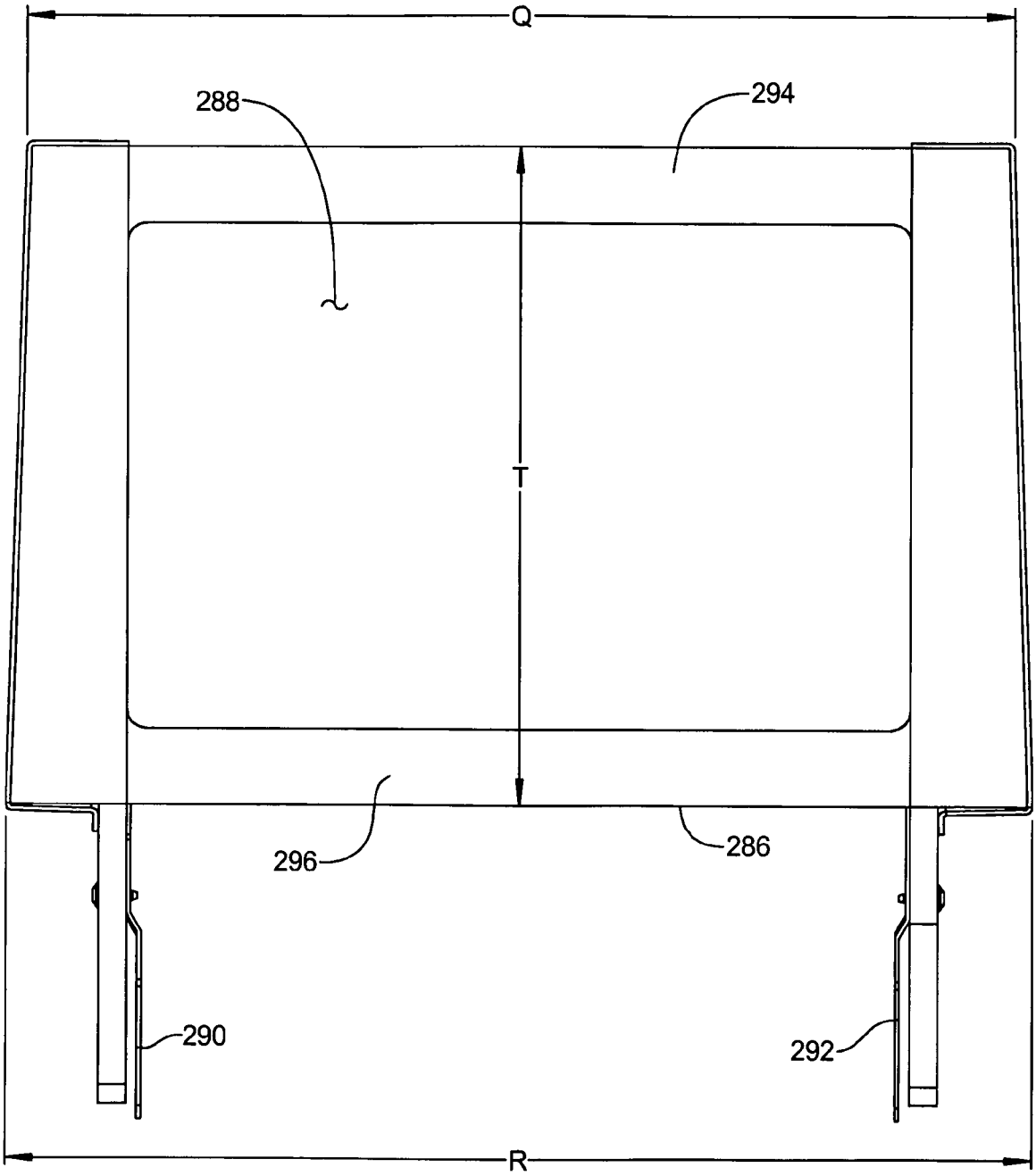
FIG. 28 is an end elevational view of the back frame of FIG. 27.

Referring now to FIGS. 27 and 28, a back frame 284 is modified from back frame 20 and is created of a single piece frame element 286 similar to seat pan 22. A clearance aperture 288 is also provided in frame element 286 to provide for displacement of first and second lumbar flat springs 128, 130 (not shown). First and second back braces 52, 54 are provided similar to back frame 20. First and second back extensions 60, 62 are provided to support upholstery sections (not shown) similar to back frame 20. First and second mounting brackets 290, 292 are fastenably connected to each of first and second back braces 52, 54 and are adapted to be connected to mechanism 16 to permit rotation of back frame 284. In several embodiments, an upper oriented cross element 294 has a width "Q" of approximately 63.5 cm (25.4 in) and can be narrower than a lower oriented cross element 296 having a width "R" of approximately 67.1 cm (26.4 in). A total height "T" of frame element 286 can be approximately 43.7 cm (17.2 in).

What is claimed is

1. A furniture member, comprising:

a support member;

a mechanism rotatably pinned to the support member and adapted for both rocking and reclining motions, including:

a first pair of forward link members;

a pantograph linkage set connected to the first pair of forward link members and operable to extend and retract a footrest assembly; and a drive rod connected to the pantograph linkage set, rotation of the drive rod operable to each of extend and retract the pantograph linkage set;

an escutcheon directly connected to a first end of the drive rod, the escutcheon including a male extending engagement member having a sloped engagement tooth extending outwardly therefrom; and a handle snap-engaged directly on the escutcheon, the handle operable to manually rotate the drive rod, the handle including an engagement aperture adapted to receive the male extending engagement member of the escutcheon to engage the handle with the escutcheon, an engagement tooth receiving aperture opening directly into the engagement aperture; and a pitched engagement slot angled to taper into and directed toward the engagement aperture and aligned with the engagement tooth receiving aperture, the sloped engagement tooth being elastically compressed by contact within the pitched engagement slot when the male extending engagement member is initially slidably received in the engagement aperture and thereafter outwardly elastically extensible to engage within the engagement tooth receiving aperture.

2. The furniture member of claim 1, wherein the sloped engagement tooth includes a raised edge and a facing skirt.

3. The furniture member of claim 1, wherein the escutcheon including the sloped engagement tooth are a polymeric material adapted to elastically and not permanently deflect during snap-engagement of the handle so a raised edge of the sloped engagement tooth provides a retention capability to prevent the handle from being removed.

4. The furniture member of claim 1, wherein a first end of the escutcheon includes the male extending engagement member having a substantially rectangularly shaped engagement drive end, and a skirt having a diameter larger than an aperture created through an upholstered section of the furniture member adapted to receive a tubular portion of the escutcheon.

5. A furniture member, comprising:

a support member;

a mechanism rotatably connected to the support member, including:

opposed first and second side plates;

a pantograph linkage set connected to the first and second side plates; and a drive rod supported for rotatable motion between the first and second side plates, rotation of the drive rod operating to each of extend and retract the pantograph linkage set;

an escutcheon directly connected to the drive rod including a sloped engagement tooth extending outwardly from an engagement drive end; and a handle directly engaged to the escutcheon independent of the drive rod for manually rotating the drive rod via the escutcheon, the handle including:

a receiving portion having an engagement drive aperture corresponding in shape and adapted to directly receive the engagement drive end;

a tooth engagement aperture opening directly into the engagement drive aperture; and a pitched engagement slot angled to taper into and directed toward the engagement drive aperture and aligned with the tooth engagement aperture; and the engagement tooth being elastically compressed by contact within the pitched engagement slot when the engagement drive end is initially slidably received in the receiving portion and thereafter outwardly elastically extensible to engage within the tooth engagement aperture defining a snap-fit of the handle with the escutcheon.

6. The furniture member of claim 5, further comprising a base frame operable to support the support member.

7. The furniture member of claim 6, comprising at least one biasing member connected between the base frame and the support member operable to permit forward and backward rocking motions of the furniture member.

8. The furniture member of claim 5, wherein the escutcheon further comprises:

a tubular portion slidably receiving the drive rod; and a skirt having a diameter larger than the tubular portion;

the engagement drive end extending outwardly from the skirt and oppositely oriented with respect to the tubular portion.

9. The furniture member of claim 5, wherein the escutcheon comprises a plurality of connection apertures individually selectable to receive a releasable pin to vary a working length of the drive rod and a width between the first and second side plates.

* * * * *

UNITED STATES PATENT AND TRADEMARK OFFICE

CERTIFICATE OF CORRECTION

PATENT NO. : 7,543,893 B2
APPLICATION NO. : 11/483700
DATED : June 9, 2009
INVENTOR(S) : Larry P. LaPointe It is certified that error appears in the above-identified patent and that said Letters Patent is hereby corrected as shown below:

Column 1, Line 60; (Application Page 2, Line 21);
"detente" should be --detent--.

Column 2, Line 15; (Application Page 3, Line 15);
"each of" should be --each to--.

Column 2, Line 33; (Application Page 4, Line 8);
"each of" should be --each to--.

Column 3, Line 11; (Application Page 5, Line 21);
After "is", insert --a--.

Column 3, Line 39; (Application Page 7, Line 1);
After "is", insert --a--.

Column 4, Line 63; (Application Page 10, Line 6);
"connected-to" should be --connected to--.

Column 7, Line 59; (Application Page 16, Line 20);
After "each", insert --of--.

Column 9, Line 24; (Application Page 20, Line 5);
After "direction", insert --"D".--.

Column 13, Line 46, Claim 1; (Amendment dated 12/04/08, Page 6, Line 9, Claim 42);
"to each of" should be --to each to--.

UNITED STATES PATENT AND TRADEMARK OFFICE

CERTIFICATE OF CORRECTION

PATENT NO. : 7,543,893 B2
APPLICATION NO. : 11/483700
DATED : June 9, 2009
INVENTOR(S) : Larry P. LaPointe It is certified that error appears in the above-identified patent and that said Letters Patent is hereby corrected as shown below:

Column 14, Line 25, Claim 5; (Amendment dated 12/04/08, Page 8, Line 8, Claim 48); "to each of" should be --to each to--.

Signed and Sealed this

Eighteenth Day of August, 2009

David J. Kappos

David J. Kappos
*Director of the United States Patent and Trademark Office*